US006568143B2

(12) United States Patent
Coleman

(10) Patent No.: US 6,568,143 B2
(45) Date of Patent: May 27, 2003

(54) INTERLOCKING CONSTRUCTION COMPONENTS

(75) Inventor: Kamron E. Coleman, Waterville, WA (US)

(73) Assignee: Withrow Block, L.L.C., Chelan, WA (US)

( * ) Notice: Subject to any disclaimer, the term of this patent is extended or adjusted under 35 U.S.C. 154(b) by 0 days.

(21) Appl. No.: 09/848,805

(22) Filed: May 3, 2001

(65) Prior Publication Data

US 2001/0054268 A1 Dec. 27, 2001

Related U.S. Application Data

(63) Continuation-in-part of application No. 09/602,614, filed on Jun. 23, 2000, now abandoned.

(51) Int. Cl.[7] ..... E04C 2/04

(52) U.S. Cl. ..... 52/604; 52/596.6; 52/606; 52/608

(58) Field of Search ..... 52/606, 592.6, 52/592.5, 608, 611, 604, 586.2; 446/124, 125

(56) References Cited

U.S. PATENT DOCUMENTS

| | | | | |
|---|---|---|---|---|
| 257,155 | A | * | 5/1882 | Dupius |
| 547,159 | A | | 10/1895 | Rosenzi |
| 1,436,551 | A | | 11/1922 | Van Duzer |
| 1,577,906 | A | | 3/1926 | Hahn |
| 2,134,637 | A | | 10/1938 | Loucks |
| 2,319,914 | A | * | 5/1943 | Blanding, Jr. |
| 2,446,179 | A | * | 8/1948 | Harnquist |
| D158,949 | S | | 6/1950 | Ferrin |
| 2,549,189 | A | * | 4/1951 | Gabo |
| 2,963,828 | A | | 12/1960 | Belliveau |
| 3,010,888 | A | * | 11/1961 | Battle |
| 3,435,576 | A | * | 4/1969 | Giannelia |
| 3,508,367 | A | * | 4/1970 | Niebylski |
| D222,569 | S | | 11/1971 | Ford |
| 3,645,059 | A | * | 2/1972 | Grimm |
| 3,787,996 | A | * | 1/1974 | Smith et al. |
| 3,804,074 | A | | 4/1974 | Illing |
| 3,834,108 | A | * | 9/1974 | Ludvugsen |
| 3,885,794 | A | * | 5/1975 | Coffin |
| 3,956,862 | A | | 5/1976 | Alexandre, Jr. |
| 4,003,172 | A | | 1/1977 | Pawl |
| 4,041,660 | A | | 8/1977 | Yensen |
| 4,041,670 | A | | 8/1977 | Kaplan |
| 4,113,256 | A | * | 9/1978 | Hutchings |
| 4,197,669 | A | * | 4/1980 | Hynes |
| 4,310,994 | A | * | 1/1982 | Gephardt |
| 4,397,578 | A | | 8/1983 | Inman |
| 4,441,298 | A | * | 4/1984 | Limousin |
| 4,489,706 | A | | 12/1984 | Hait |
| 4,782,640 | A | | 11/1988 | Schweiller |
| 4,925,338 | A | * | 5/1990 | Kapusta |
| 5,186,161 | A | | 2/1993 | Shumock |
| 5,221,223 | A | * | 6/1993 | Kao |
| 5,284,125 | A | | 2/1994 | Hunziker |
| 5,421,321 | A | | 6/1995 | Ward |

(List continued on next page.)

FOREIGN PATENT DOCUMENTS

| | | | |
|---|---|---|---|
| AT | 73242 | * | 1/1915 |
| DE | 2239988 | * | 8/1972 |
| GB | 969794 | * | 9/1964 |

*Primary Examiner*—Blair M. Johnson
(74) *Attorney, Agent, or Firm*—Wells St. John P.S.

(57) ABSTRACT

Interlocking masonry components are described herein, including a first masonry block formed along a first axis, with first interlock surface on the first masonry block, formed at an oblique angle to the first axis. A second masonry block is formed along a second axis with a second interlock surface formed at an oblique angle to the second axis. The first and second interlock surfaces interfit and longitudinally interlock with the first and second axes in substantial alignment.

32 Claims, 28 Drawing Sheets

U.S. PATENT DOCUMENTS 5,567,194 A * 10/1996 Stapleton
5,688,078 A 11/1997 Hammer
D396,166 S 7/1998 Pavlich
5,881,511 A 3/1999 Keller, Jr.
6,070,572 A 6/2000 Casagrande
D438,943 S 3/2001 Coleman
D439,316 S 3/2001 Coleman

* cited by examiner 10
20
22
34
Y
56
30
14
40
18
16
13
17
12
X
60
26
41
42
43
31

10
12
35
43

INTERLOCKING CONSTRUCTION COMPONENTS

RELATED APPLICATIONS

This application is a continuation-in-part of co-pending U.S. patent application Ser. No. 09/602,614 filed Jun. 23, 2000, abandoned.

TECHNICAL FIELD

The present invention relates to block construction in general and more specifically to interlocking construction components.

BACKGROUND OF THE INVENTION

Various forms of block configurations have been developed for construction of retaining walls, columns, foundations and the like. Some blocks are provided with holes that can be aligned during stacking to receive an interlock member such as a length of reinforcing bar. Others are provided with tongue and groove or interfitting tabs and sockets that are used to "lock" the blocks together. In either instance, the blocks may be assembled in only very limited structural configurations.

Another difficulty with formed construction blocks is that many existing block shapes are repetitive and may not be re-arranged to vary the decorative face appearance of finished construction.

The present invention provides interlocking construction components that will securely interlock without need for mortar or reinforcing bars, and that will allow construction in a variety of configurations without compromising the interlocking nature of the components.

BRIEF DESCRIPTION OF THE DRAWINGS

Preferred embodiments of the invention are described below with reference to the following accompanying drawings, in which:

FIG. 27 is a perspective view of a wall structure formed with "L" shaped corner blocks and an internal tie bar extending between the two partially formed walls;

FIGS. 66 and 67 are perspective views of an exemplary first block that is substantially a mirror image of the block shown in FIGS. 62–65;

FIG. 70 is a perspective view of an exemplary first block in a semi-circular configuration;

FIGS. 71–73 are orthographic views of the block shown in FIG. 70;

FIG. 74 is an exemplary key block 50 configuration in the shape of a truss;

FIGS. 76, 77 and 78 are perspective views showing exemplary wall configurations using the block configurations shown in FIGS. 48–52.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Before describing specific preferred features of the present invention, descriptions will be given with regard to general aspects thereof.

Figure 14:
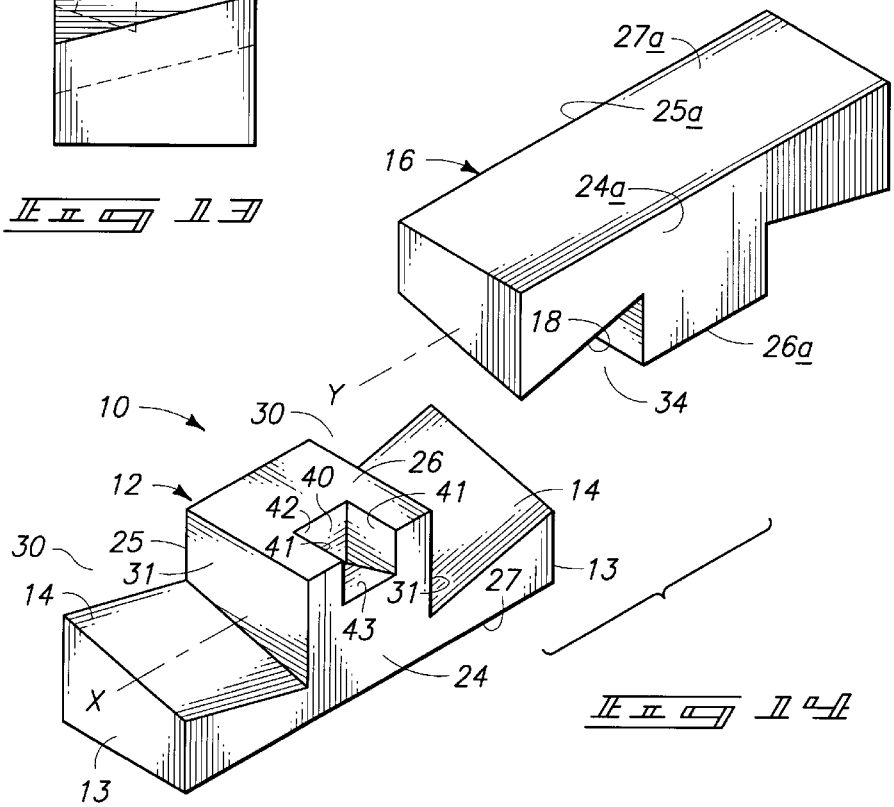
FIG. 14 is a perspective view of the block illustrated in FIGS. 11, 12, and 13.
Figure 15:
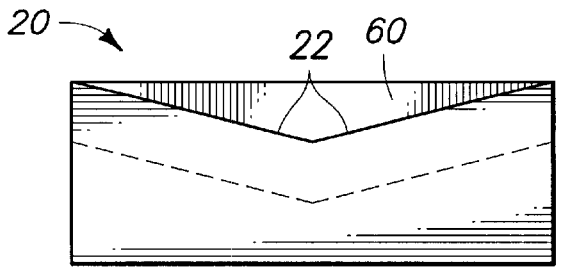
FIG. 15 is a rear end elevation view of a junction block.
Figure 16:
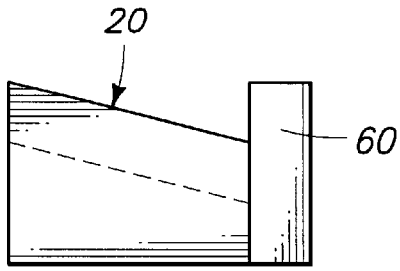
FIG. 16 is an end view of the junction block as seen from the right in FIG. 15.
Figure 17:
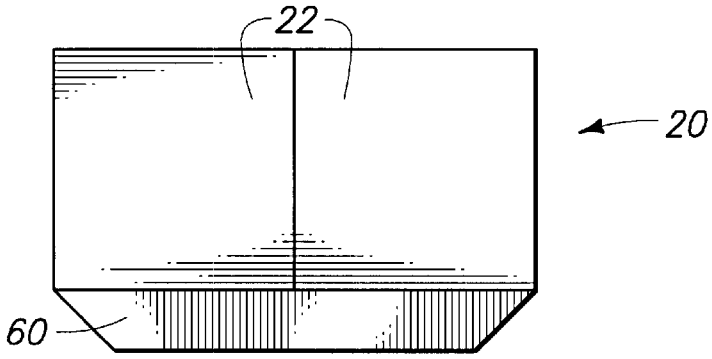
FIG. 17 is a top plan view of the junction block.
Figure 28:
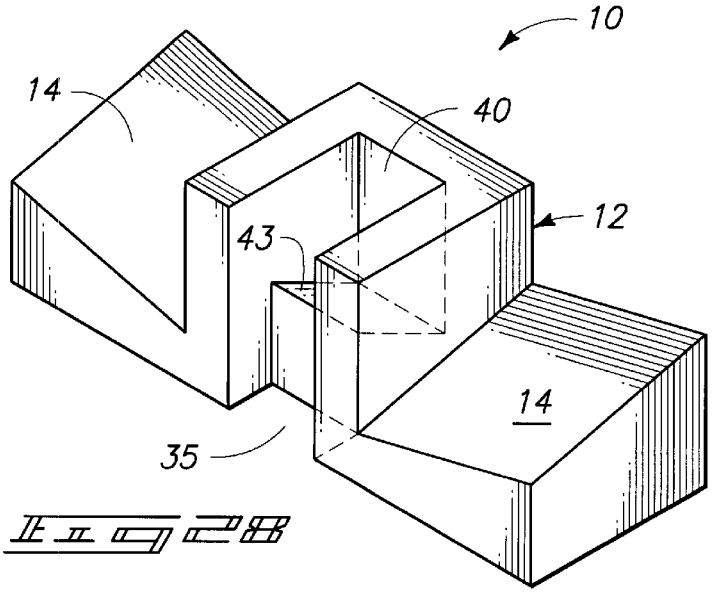
FIG. 28 is a perspective view of a first block configuration having a head receiving recess.
Figure 29:
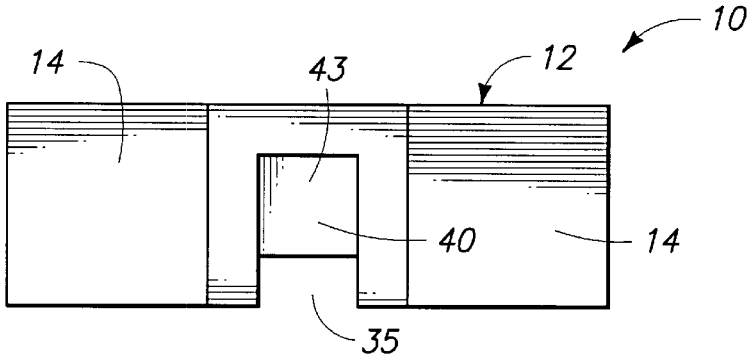
FIGS. 29–31 are orthographic views of the block shown in FIG. 28.
Figure 30:
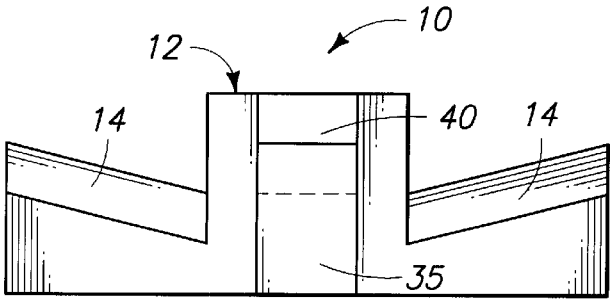

In one preferred aspect (examples of which are generally represented in FIGS. 14, 28 and others), the present interlocking construction components 10 are provided with a first block 12 formed along a first axis X. A first interlock surface 14 is provided on the first block 12, formed at an oblique angle to the first axis X. A second block 16 is formed along a second axis Y. A second interlock surface 18 is provided on the second block 16 formed at an oblique angle to the second axis Y. The first and second interlock surfaces 14, 18 interfit and longitudinally interlock with the first and second axes X and Y in substantial alignment.

Figure 18:
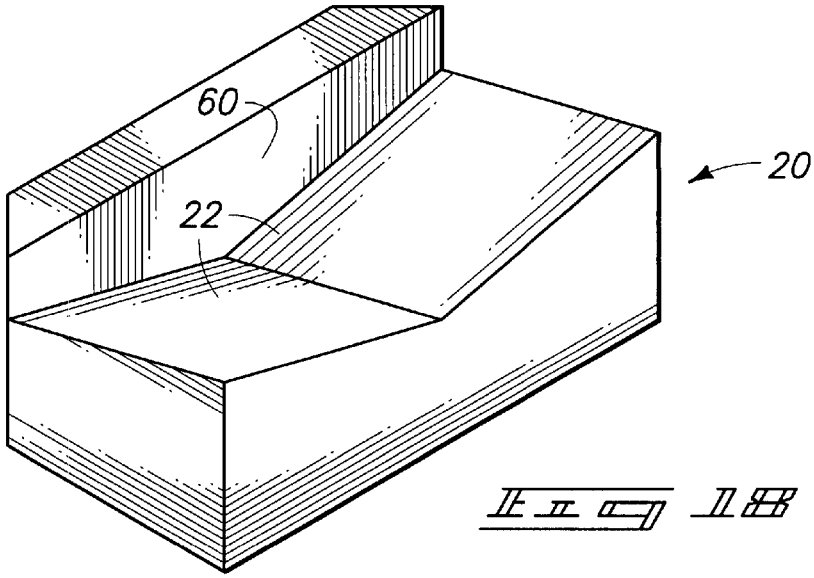
FIG. 18 is a perspective view of the junction block illustrated in FIGS. 15, 16, and 17.
Figures 22, 23, 24:
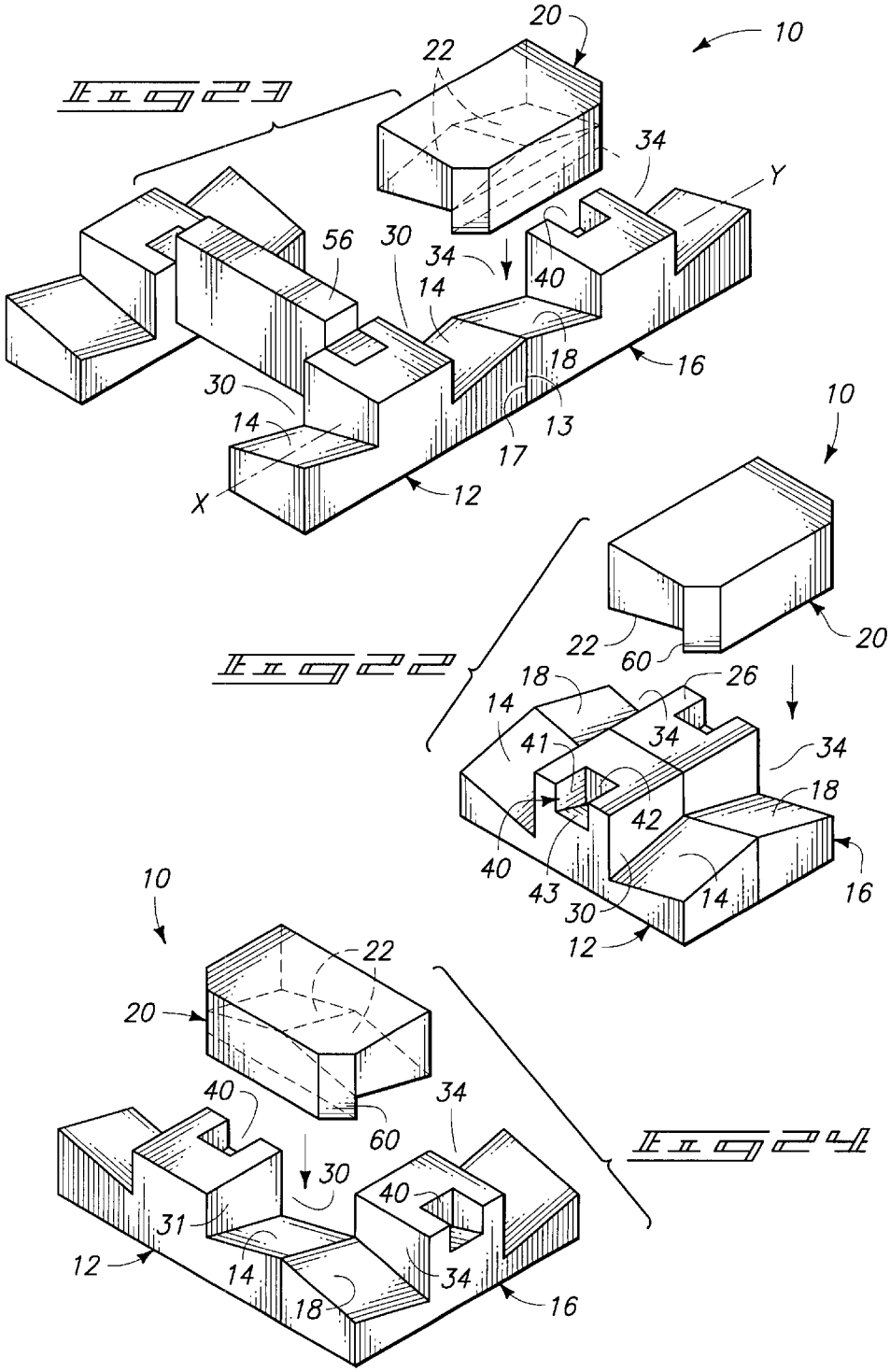
FIG. 22 is a partially exploded perspective view showing two straight block components being joined in side-by-side relation by a junction block.
FIG. 23 is a partially exploded perspective view showing two straight block components being joined in an aligned straight run using a junction block.
FIG. 24 is a partially exploded perspective view showing two straight blocks being joined in a right angle orientation by a junction block.

In another aspect, one example of which is generally in FIGS. 23, 24, and others, the interlocking construction components include a first block 12 with a first end 13. A first interlock surface 14 is formed across the first end 13. A second block 16 includes a second end 17, with a second interlock surface 18 formed across the second end 17. A junction block 20 is also provided, with symmetrical, mirror image mating surfaces 22 (best exemplified in FIG. 18) that are complementary to the first and second interlock surfaces 14, 18 for joining the first and second blocks 12, 16 together in end-to-end engagement. The mirror image mating surfaces 22, the first interlock surface 14, and the second interlock surface 18 interchangeably interfit in any of several angular relationships (compare FIGS. 23 and 24).

In another aspect (again referring generally to the example illustrated in FIG. 14 and others), the interlocking components 10 include a first elongated block 12 with side surfaces 24, 25 joined by top and bottom surfaces 26, 27 defining a cross sectional shape at a block end 13. A first notch 30 is formed in the first block 12 and is defined by: (a) the block end 13, (b) a notch end surface 31 spaced along the block from the block end 13, and (c) an interlock surface 14 oriented at an oblique angle to and joining the block end and the notch end surface. A second block 16 includes a second notch 34 formed therein of complementary configuration to the first notch 30 for reception by the first notch 30.

In a still further aspect (refer generally to FIG. 25 and others), the interlocking construction components 10 include a first block 12 with side surfaces 24, 25 joined by top and bottom surfaces 26, 27 defining a cross-sectional shape. A key socket 40 is formed in the first block 12 and opens on two adjacent ones of the surfaces 24–27. The key socket 40 is defined by side socket walls 41 leading to an end socket wall 42 and a bottom socket wall 43. At least one of the side and bottom socket walls 41, 43 forms an acute angle (see FIG. 6) with the end socket wall 42. A second block 16 with second side surfaces 24*a*, 25*a* joined by second top and bottom surfaces 26*a*, 27*a* is received in stacked relation on the first block 12 with at least two of the side surfaces 24, 24*a* or 25, 25*a* positioned adjacent the key socket 40 and substantially coplanar. A key member 50 is also provided, having a key tail 51 shaped complementary to and slidably received within the key socket 40, and a buttress head 52 with at least one side surface abutment wall 53 projecting from the key tail 51 and in flush engagement with the second block 16.

In another aspect, interlocking construction components 10 include a first block 12 that includes a key socket 40. An inclined socket wall 43 is provided within the key socket. A head receiving recess 35 is formed in the first block and adjoins the key socket 40. A key block 50 includes an inclined surface 53 that is formed in complementary shape to the inclined socket wall 43, to interlock therewith the key socket 40. A head on the key block 50 is shaped to be received within the head receiving recess with the inclined socket wall engaging the inclined surface of the key block.

In another aspect, interlocking construction components 10 include a first block 12 and a key socket 40 on the first block with an inclined socket wall 43 formed within the key socket. A head receiving recess 35 is formed in the first block 12 and adjoins the key socket 40. A key block 50 includes an inclined surface 57 that is formed in complementary shape to the inclined socket wall 43 to interlock therewith. A head 52 on the key block 50 is shaped to be received within the head receiving recess 35 and with the inclined socket wall engaging the inclined surface of the key block 50. A first interlock surface 14 is provided on the first block 12, formed at an oblique angle. A second block 16 is provided, with a second interlock surface 18, which is formed at an oblique angle. The first and second interlock surfaces 14, 18 interfit and secure the first and second blocks together.

It is pointed out that the components described herein may be made of concrete, mortar or other cementitious moldable products, by casting, injection molding, or by other conventional forming processes. It is also conceivable that some or all of the described components could be made of other materials such as glass, ceramics, wood, metal or plastic (solid, foamed or expanded bead plastics) using conventional forming techniques and equipment. "Masonry" as used herein is to be understood simply one preferred material for construction of the present components, and the term should be considered as exemplary of many other materials that could also be used.

It is also noted that throughout this disclosure, spatial or directional adjectives such as "top", "bottom", "side", etc. are used for convenience of description and ease of understanding with respect to the orientation of the examples illustrated in the drawings. In actual use, the components may be oriented in various other positions (inverted, rotated or otherwise differently positioned) so, for example, a top surface may become a bottom surface. FIG. 14 exemplifies one such arrangement where the second masonry block 16 is inverted and the top surface 26*a* is downwardly oriented.

It is pointed out that the first and second blocks 12, 16 may be of different configurations, be substantially identical to one another, or may differ merely in terms of dimension. The present blocks may be provided in various sizes and shape, but with mating interlock or lock surfaces.

The blocks 12, 16 may also be formed in shapes other than straight sections. See for example, the "L" shaped block 64 in FIGS. 7–10 and 62–69. The interlock or interfitting lock surfaces thereon may be made to mate whatever the nature (straight, angled or curved) of the blocks. Common reference numerals will thus be used to identify similar features of the interlock surfaces on the first and second blocks.

Figure 19:
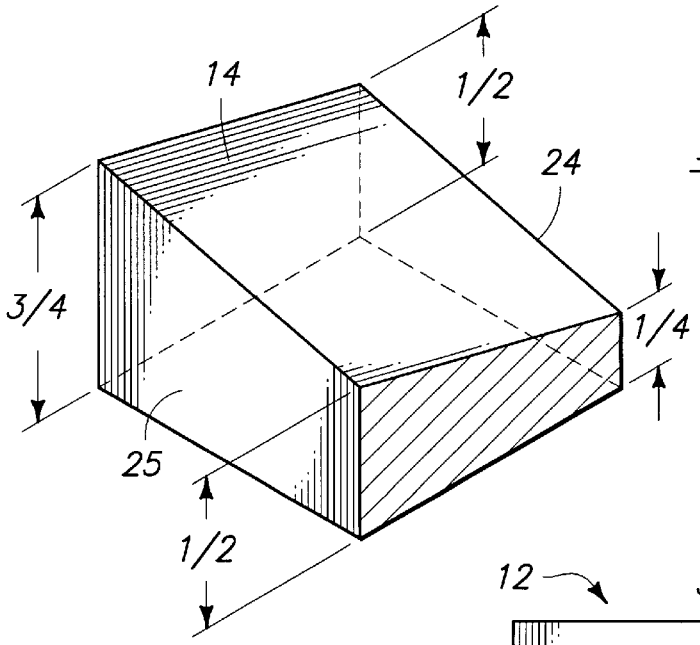
FIG. 19 is a partially sectioned view illustrating spatial relationships of an interlock surface that is common in various aspects of the present interlocking components.
Figure 20:
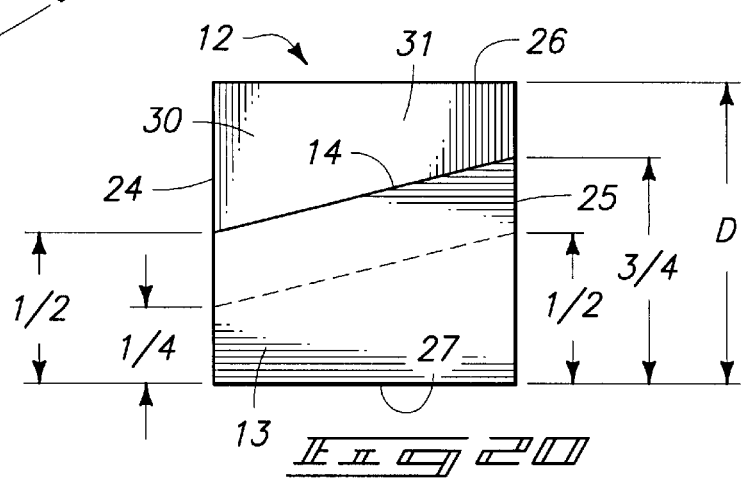
FIG. 20 is an end view of a block with measurements to show spatial relationships at corners of the interlock surface as related to the thickness dimension of the associated component.
Figure 31:
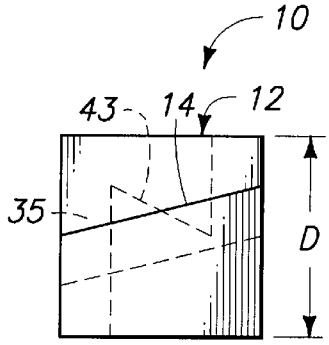
Figure 32:
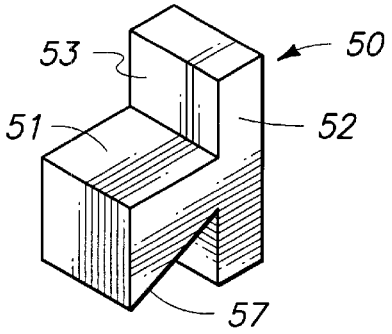
FIG. 32 is a perspective view of an exemplary key block configuration.
Figure 33:
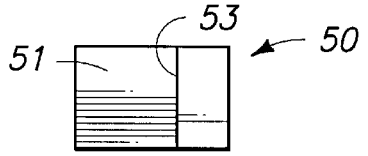
FIGS. 33–35 are orthographic views of the block shown in FIG. 32.
Figure 34:
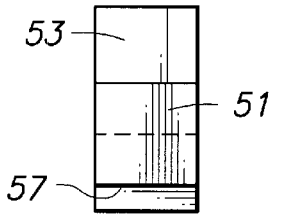

Reference will now be made in greater detail to exemplary preferred interlock surfaces. Looking at the example illustrated in FIGS. 19 and 20, particular preferred dimensions for exemplary first interlock surfaces are shown, although the same or at least substantially similar dimensions could be given for the second interlock surfaces on the second block. In the illustrated example, each interlock surface intersects respective side surfaces 24, 25 at quarter divisions of a thickness dimension D between the top and bottom surfaces. This relationship is shown, given an overall thickness dimension D of one unit. Both of the first and second masonry blocks may include top and bottom surfaces defining equal or substantially equal thickness dimensions D (see FIGS. 20 and 31).

Figure 25:
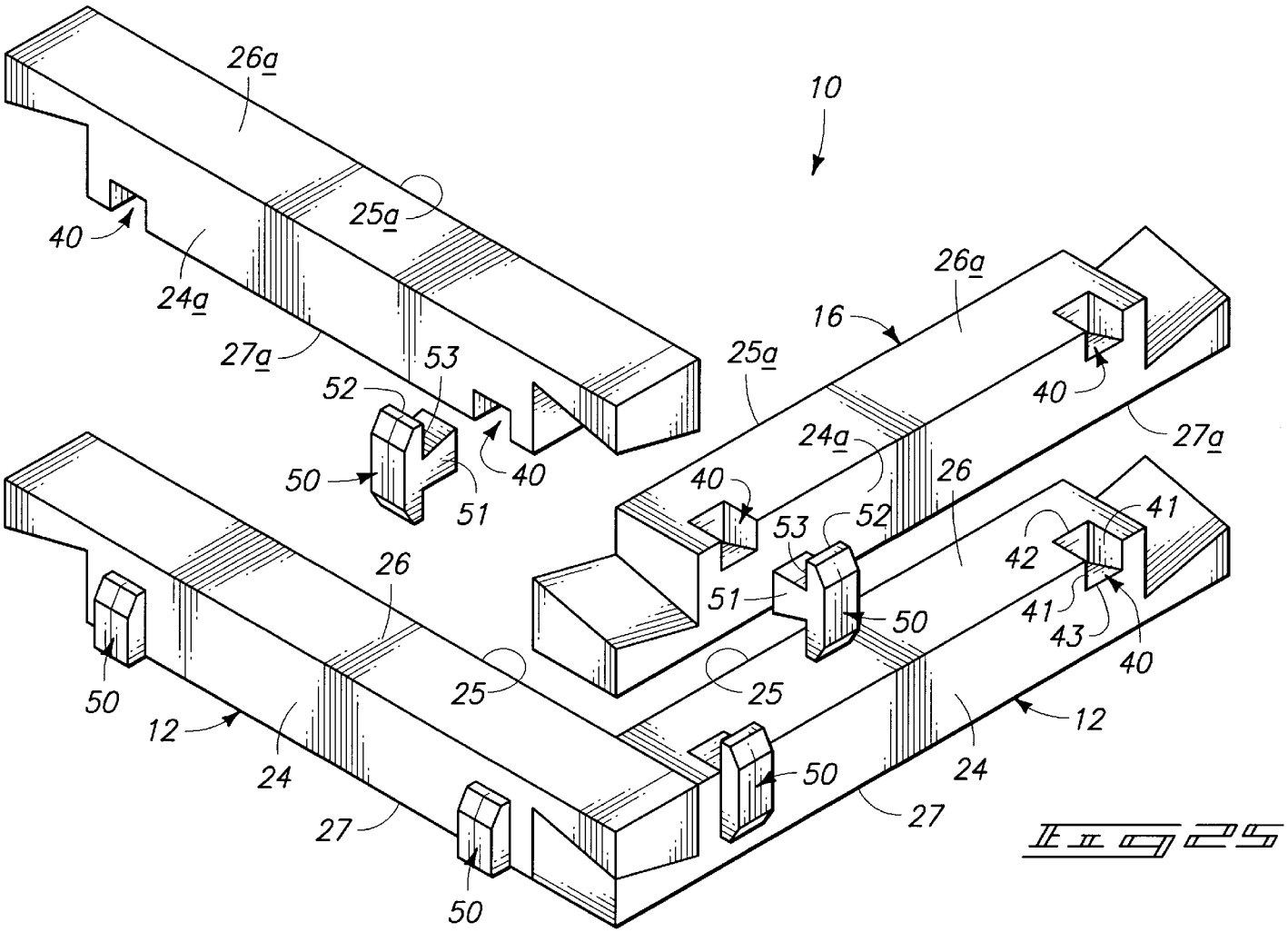
FIG. 25 is a partially exploded perspective view showing two straight blocks being joined to one another in a right angle orientation.

Each of the interlock surfaces 16 or 18 may be bounded by edges forming a four-sided polygonal configuration, with corners of the polygonal configuration spaced toward the top surface 26 from the bottom surface 27 by distances of approximately ¾, ½, ½ and ¼ of the one unit thickness dimension D. This relationship permits the blocks to be joined to one another, either in a straight line with the axes X and Y substantially aligned (FIG. 14), or at an angle (FIG. 25). In either case, the interlock surfaces preferably mate in a positive locked relation. Thus, the user has the option of joining the blocks in a straight run, or may use the same blocks to make angle bends. Further, certain blocks may be angled between ends, as shown by the "L" shaped block 64 to enable formation of corners.

Figure 11:
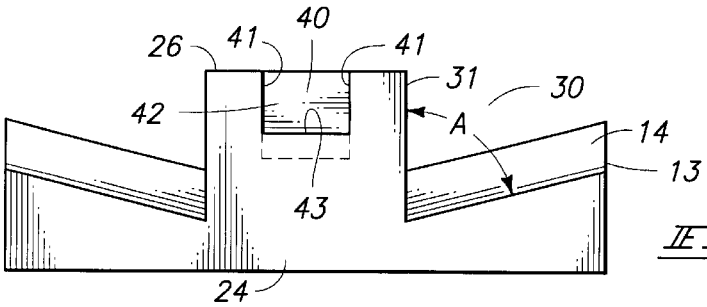
FIG. 11 is a front elevation view of a preferred block configuration.
Figure 12:
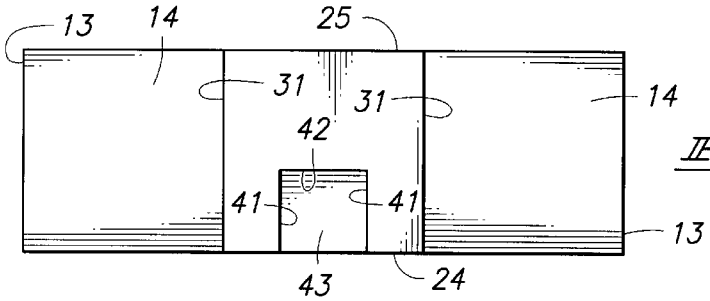
FIG. 12 is a top plan view of the FIG. 11 block configuration.
Figure 13:
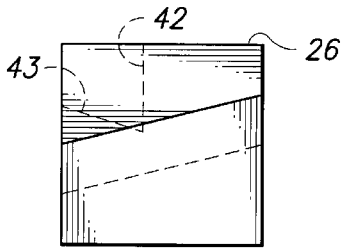
FIG. 13 is an end view as seen from the right in FIG. 11.

It is of interest to note that exemplified interlock surfaces 14, 18 may be formed at oblique angles with respect to the axes X and Y. More specifically, the surfaces may form an inclusive acute angle A (FIG. 11) with the adjacent notch end surface 31 (which may be formed perpendicular to the side and top surfaces of the block). Thus the interlock surfaces lead angularly toward the bottom surfaces from the adjacent block ends. This angular relationship further enables a positive interconnection of adjacent blocks when joined end-to-end, whether in a straight line or at right angles. Blocks thus will not have a tendency to pull apart lengthwise. The angularly interlocked surfaces will also resist relative lateral movement.

In exemplary forms, key sockets 40 and key members 50 may be provided to further assure lateral stability. At least the first blocks (and possibly both first and second blocks) may be provided with one or more of the key sockets 40, each of which opens along adjacent side and top surfaces of the associated block. The positions (along either side surface 24–24*a*, 25–25*a* and top surface 26–26*a*) are preferred for ease in forming the blocks. However, the sockets 40 could as well be formed along adjacent side and bottom surfaces of the blocks. Still further, the blocks could be formed with sockets positioned alternately along both top and bottom surfaces.

As generally described, each socket 40 is defined by socket side walls 41, an end wall 42, and a bottom socket wall 43. It is preferred that one of the side walls 41 or bottom wall 43 form an acute angle B (FIG. 6) with the socket end wall 42. In the preferred forms, the bottom wall 43 is angled to form an inclusive acute angle with the end wall 42 (see FIG. 6). However, it is quite possible for either one or both of the side walls 41 to be similarly angled to form inclusive acute angles with the end wall.

In certain preferred forms, the key members 50 may be formed with a tail 51 that is of a complementary shape to the sockets 40. The tail may thus be slidably fitted within any selected socket 40 and be effectively locked in position by reason of the mating angled surfaces.

Figure 6:
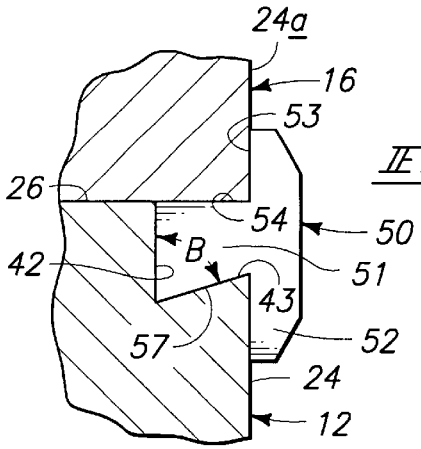
FIG. 6 is a segmented sectional view through two stacked blocks and showing a preferred key member fitted to a key socket in one of the blocks.
Figure 7:
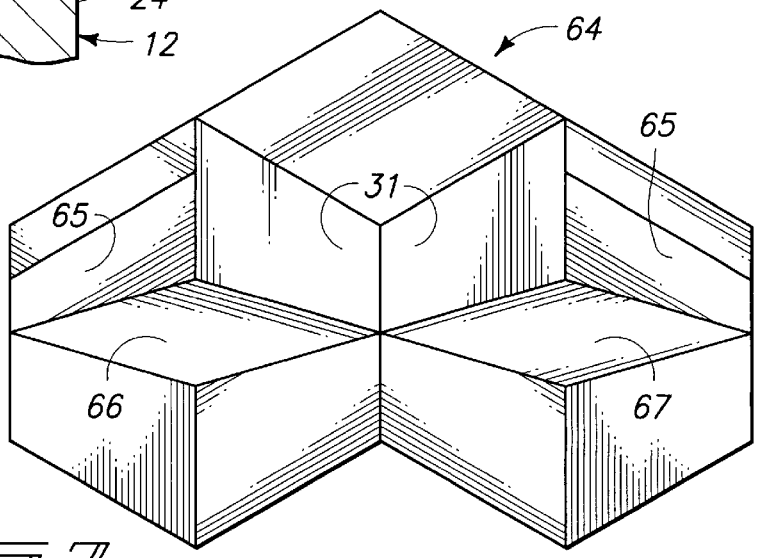
FIG. 7 is a perspective view of a corner "L" block.
Figure 8:
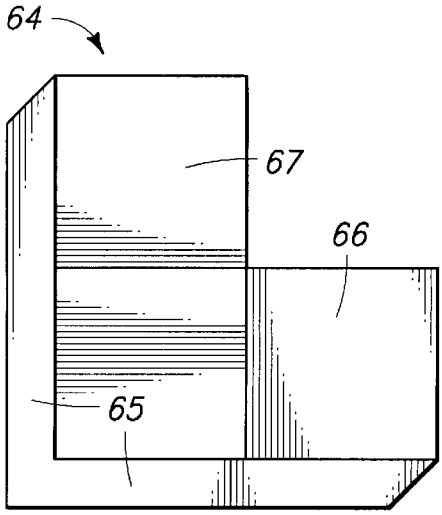
FIG. 8 is a top plan view of the "L" shaped block as seen from above in FIG. 7.
Figure 9:
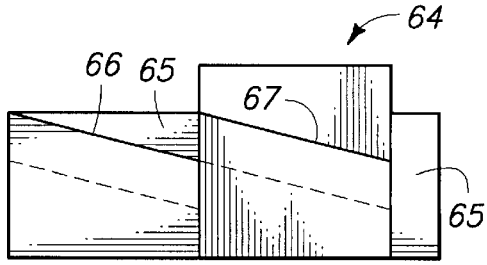
FIG. 9 is a side elevation view of the "L" shaped block as seen from the right in FIG. 7.
Figure 10:
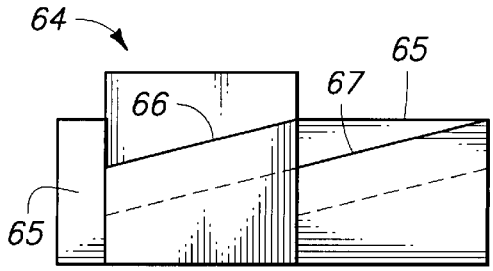
FIG. 10 is a side elevation view of the "L" shaped block as seen from the left in FIG. 7.

As shown in FIG. 6, one preferred form of the key member 50 may be mounted to a block, with a top surface 54 of the key tail 51 flush or coplanar with the top surface 26 of the block. In this configuration, the next block 16 resting on the top surface of the present block may span and close the socket 40 to prevent the key 50 from being extracted vertically, while the interlocked key tail and socket walls prevent lateral extraction. The buttress head 52 in this configuration may be exposed outward of and in locked position relative to the engaged blocks, with the abutment wall 53 thereof positioned to engage in flush abutment with the aligned and adjacent side surfaces of the two stacked blocks. The keys 50 will thus effectively prevent lateral movement of the engaged blocks in a direction toward the buttress heads 52.

Figure 1:
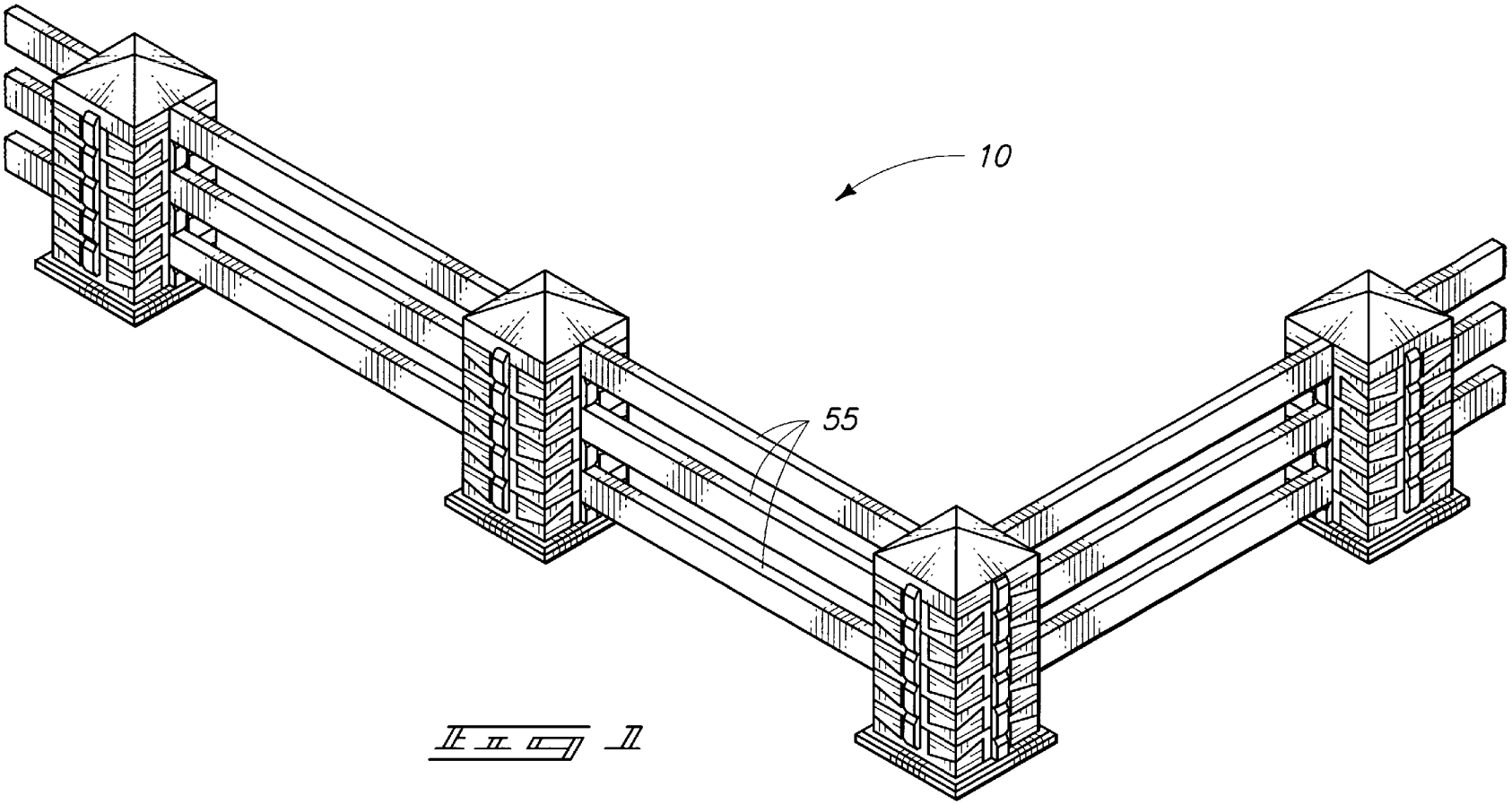
FIG. 1 is a perspective view of a fence section using preferred components of the present invention.

It is pointed out that the sockets 40 may be used for construction members other than the key members 50. For example, FIG. 1 shows elongated rails 55 with ends fitted in appropriate sockets 40 to form a fence. Similarly, a gable end or truss incorporating key configurations is shown in FIG. 74. Other configurations may also be produced.

Figure 4:
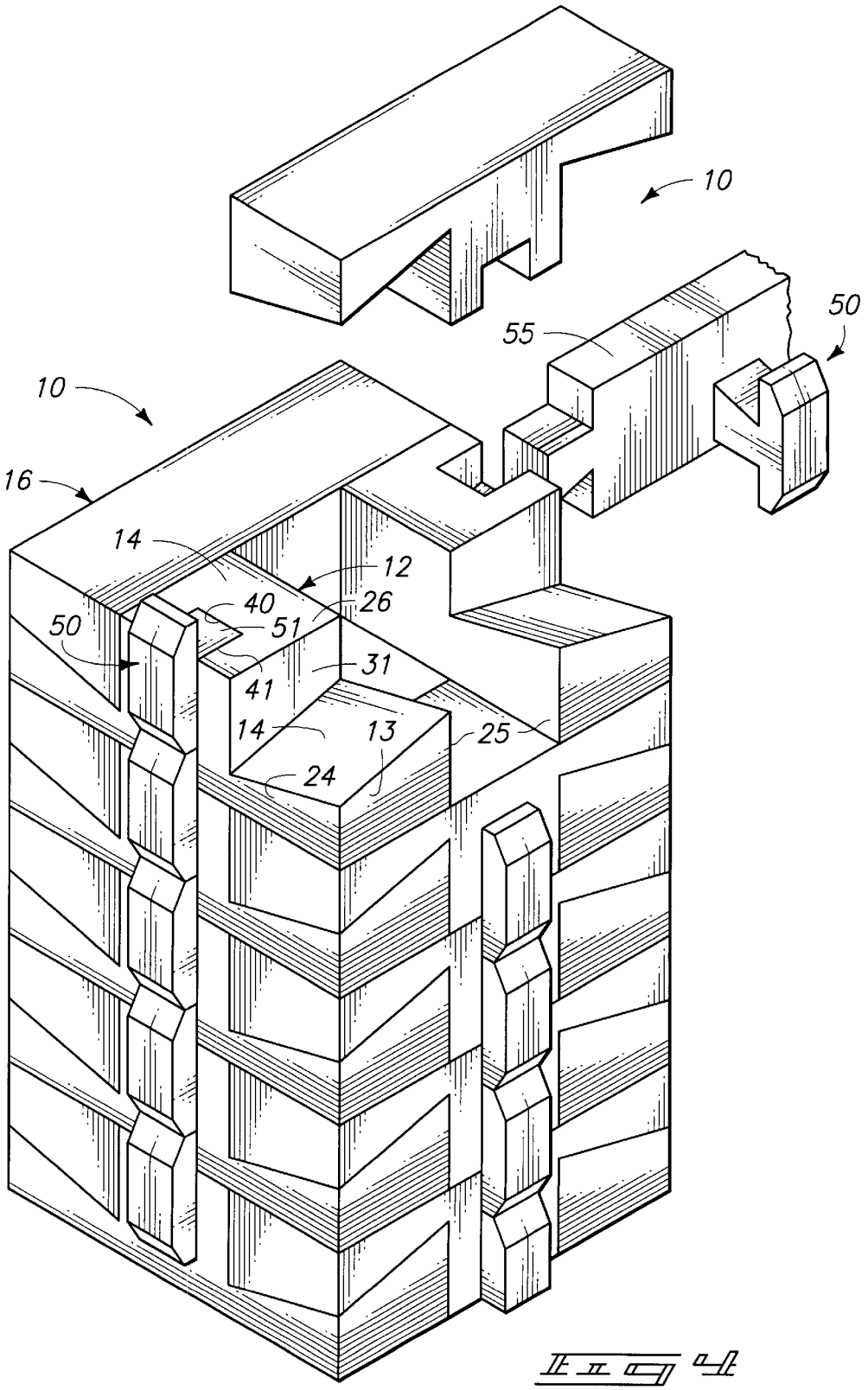
FIG. 4 is a partially exploded perspective view of the pillar or post shown in FIG. 2.
Figure 26:
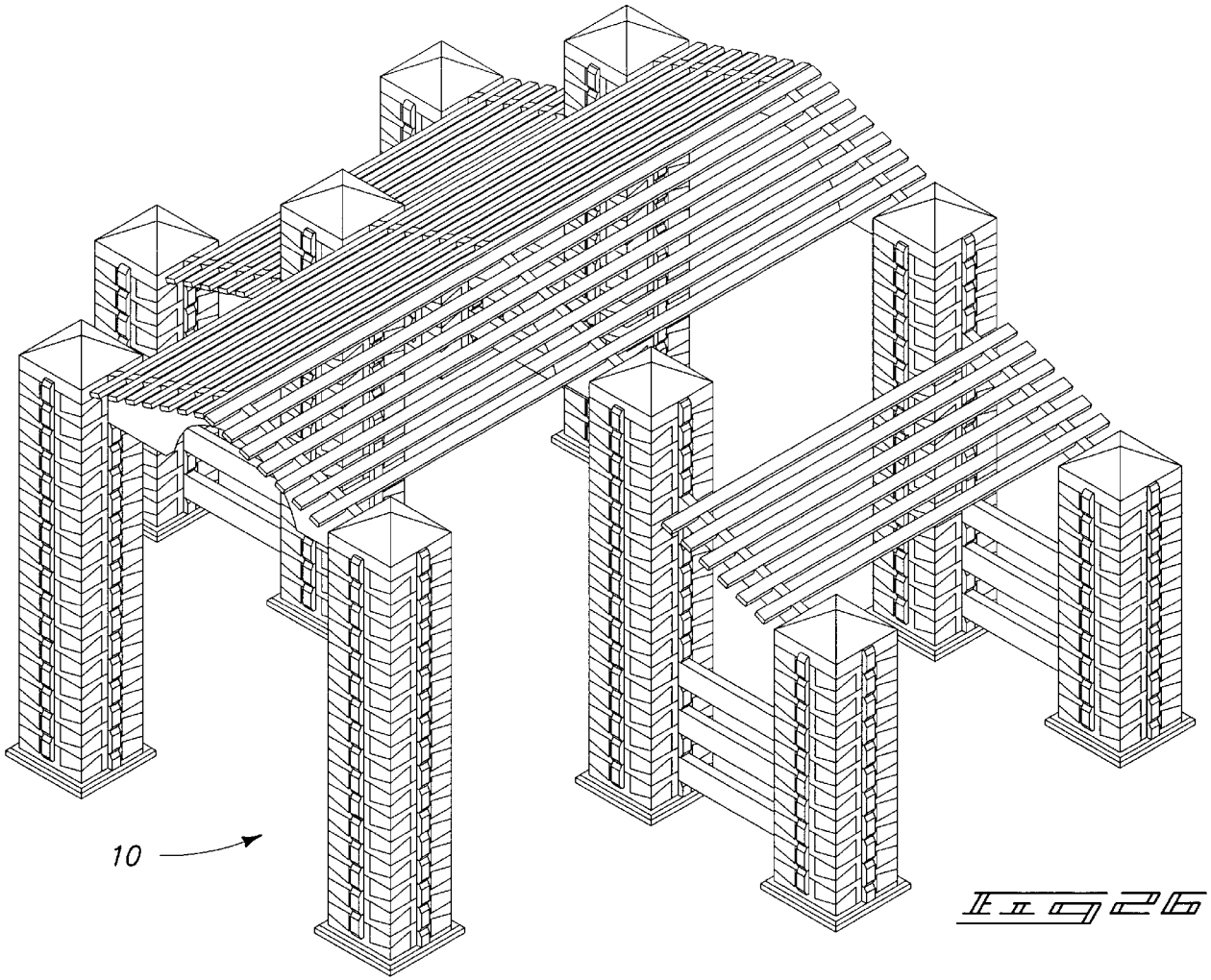
FIG. 26 is a perspective view of a pergola constructed with the present interlocking construction components.
Figure 11:
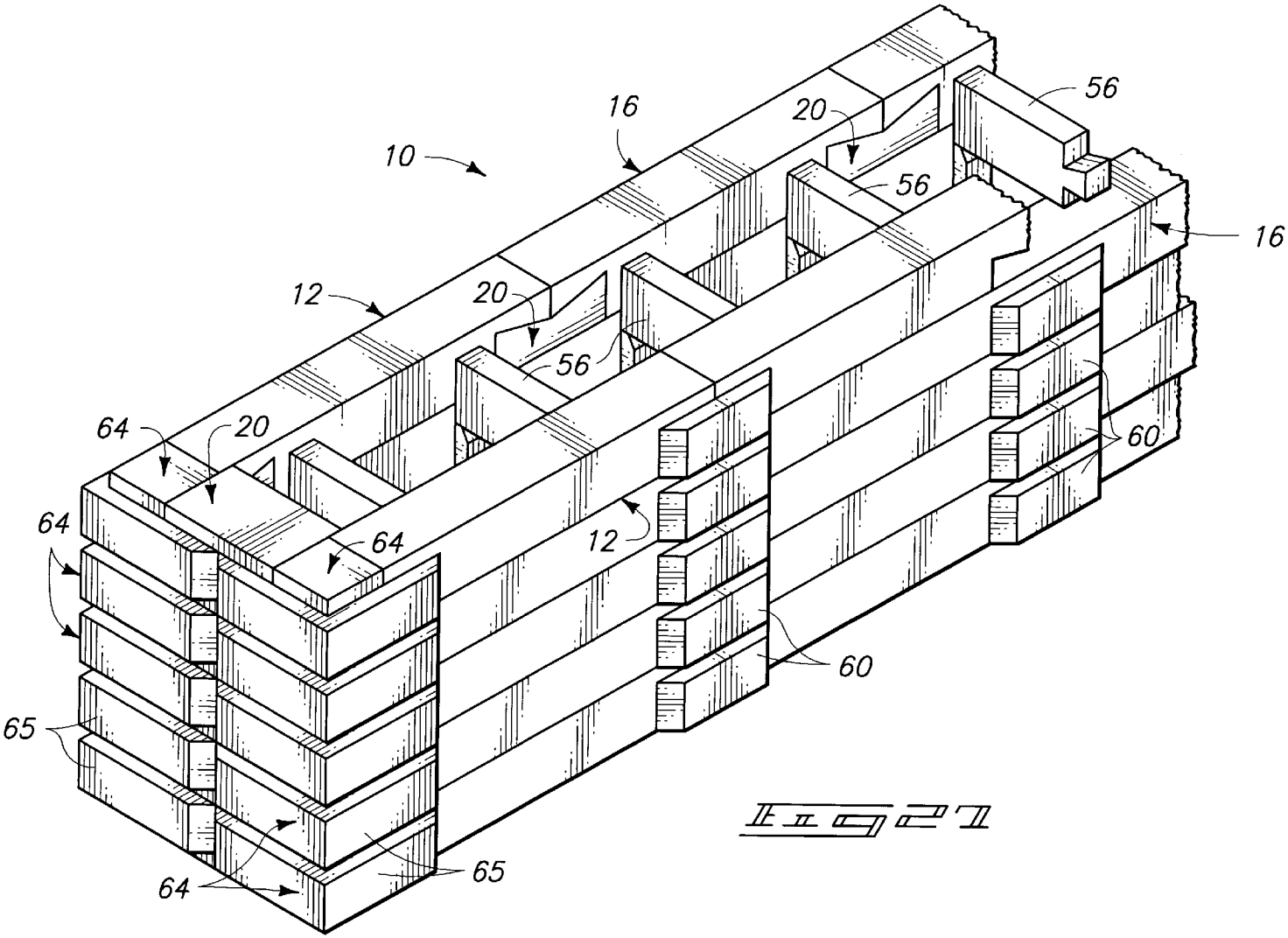

The rails 55 may be provided with tails (an example of which is shown in FIG. 4) shaped similarly to that shown for the key members, and may be formed of concrete, steel, wood, or any other appropriate structural material. Other decorative or structural forms, such as arch members, rafters, joists, pediments, and other structure may be made to mount to the sockets 40, some of which are exemplified in FIGS. 26, and 75.

FIGS. 15–18 show an exemplary form of junction block 20 in detail. The examples illustrated there include symmetrical, mirror image mating surfaces 22 that are complementary to, or may be considered as the first and second interlock surfaces 14, 18. The surfaces 22 are formed at complementary angles to be received in flush engagement with the adjacent interlock surfaces 14, 18 on another block when successive blocks are arranged in various end-to-end relationships (as noted in FIGS. 22–24).

It is of particular interest to note that a number of different block arrangements with similar interfitting capabilities allow for use of the junction block 20. For example, FIG. 23 shows blocks 12, 16 joined in a straight line end-to-end arrangement (with the axes X and Y in substantial alignment); FIG. 22 shows a junction block 20 joining two blocks 12, 16 that are positioned in side-by-side relation; and FIG. 24 shows a junction block joining the same two blocks 12, 16 positioned at right angles to one another.

At least some forms of the junction blocks 20 may include buttress surfaces 60 which may be situated adjacent the mating surfaces 22. The exemplary buttress surfaces 60 may function in a similar manner as the keys 40, to limit lateral movement of upwardly adjacent blocks.

The "L" shaped blocks 64 briefly alluded to above may be made to include the same components as the straight blocks, but with the interlock surfaces 66, 67 angularly disposed. The illustrated angles are approximately 90°, but other angles could be used as well. The "L" shaped blocks could be produced with inclusive angles of, say, 120° for construction of a gradual bend in a retaining wall or for construction of an octagonal column. Other angles could be used as well.

The "L" shaped blocks may also be provided with buttress surfaces 65 adjacent at least one and preferably both interlock surfaces 66, 67. The surfaces 65 may be used in the same manner as the other buttress surfaces on the junction blocks and the key members 50; to resist lateral movement of the blocks engaged thereby.

Referring to FIG. 28, the first block configuration 12 is shown to include the key socket 40 which, in illustrated form, is positioned between the first interlock surfaces 14 at opposed ends of the block and that are oriented substantially as described earlier for the block configuration shown in the FIG. 14 example. The key socket 40 may be provided on selected adjoining surfaces of the block 12, and most preferably adjacent to or adjoining the head receiving recess 35. The key socket 50 and head receiving recess are configured to receive and interfit with the key block 50 which, in the examples illustrated in FIGS. 32–47, may be shaped similarly to the key block described above.

Referring to FIGS. 32–47, the interlocking construction components include key block 50 configurations each of which may include a tail that includes the inclined surface 57. The head, in this configuration may be substantially normal to the tail.

Figure 35:
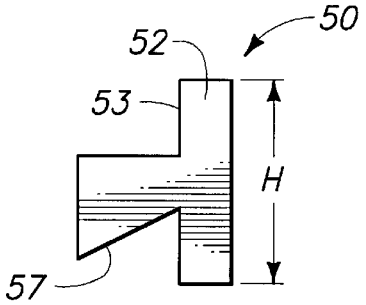
Figure 36:
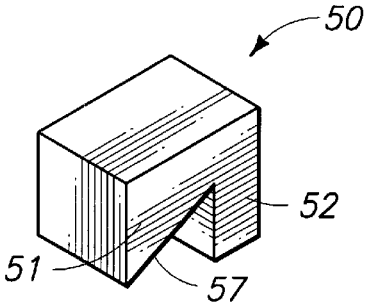
FIG. 36 is a perspective view of another exemplary form of key block.
Figure 38:
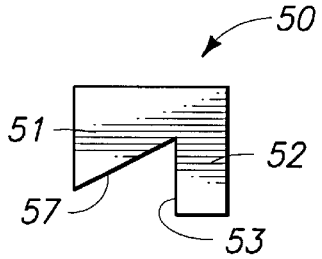
FIGS. 37–39 are orthographic views of the exemplary block shown in FIG. 36.
Figure 37:
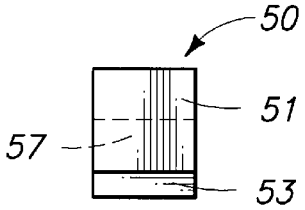
Figure 39:
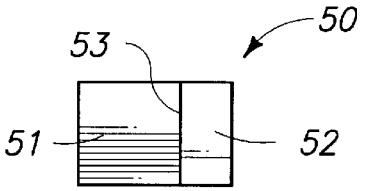
Figure 40:
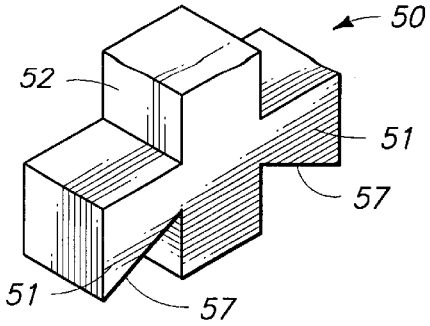
FIG. 40 is a perspective view of another exemplary form of key block.
Figure 41:
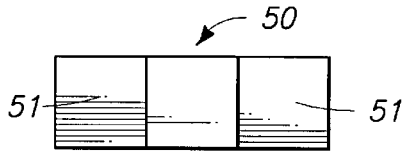
FIGS. 41–43 are orthographic views of the exemplary block shown in FIG. 40.
Figure 42:
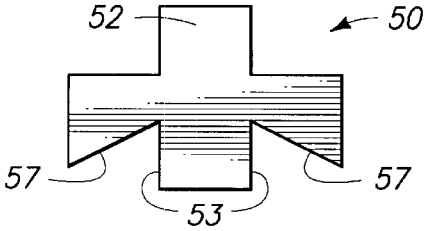
Figure 43:
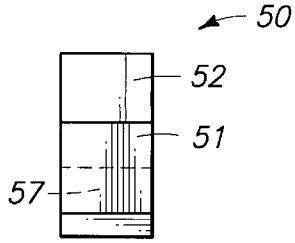
Figure 44:
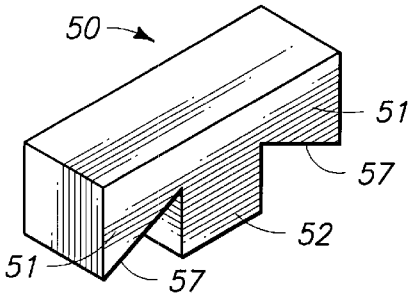
FIG. 44 is a perspective view of a further exemplary key block configuration.
Figure 45:
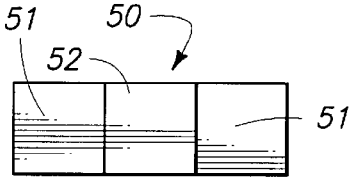
FIGS. 45–47 are orthographic views of the exemplary block shown in FIG. 44.
Figure 46:
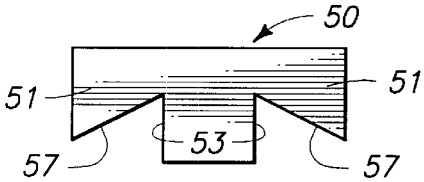
Figure 47:
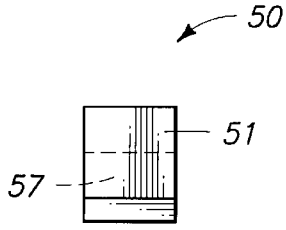
Figure 48:
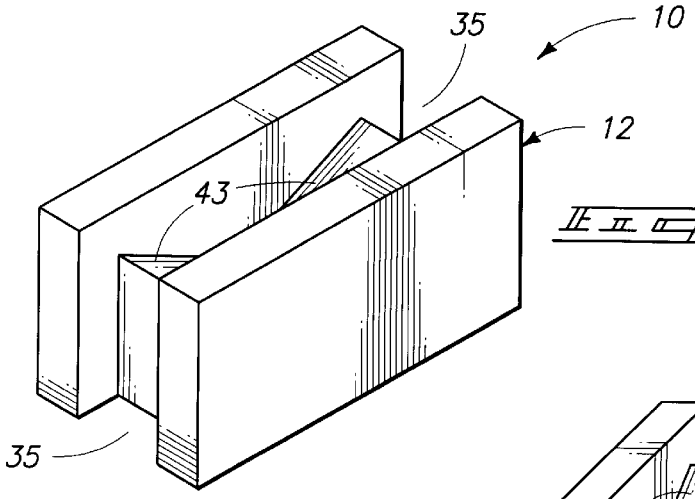
FIG. 48 is a perspective view of an exemplary first block configuration.
Figure 49:
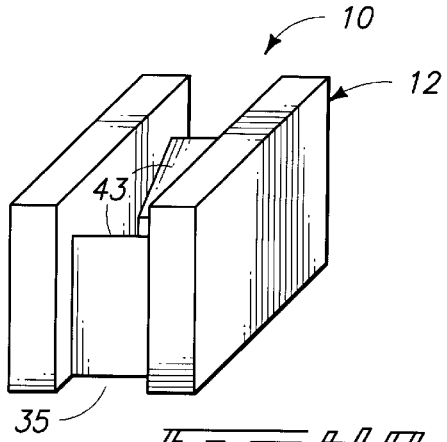
FIG. 49 is a view of a block similar to that shown in FIG. 48 but having a different length dimension.
Figure 50:
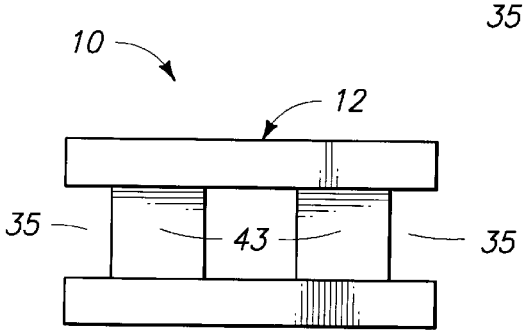
FIGS. 50–52 are orthographic views of the block exemplified by FIG. 48.
Figure 51:
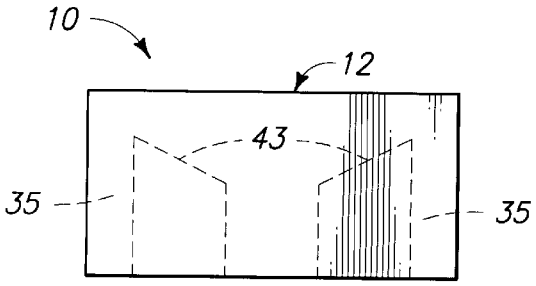
Figure 52:
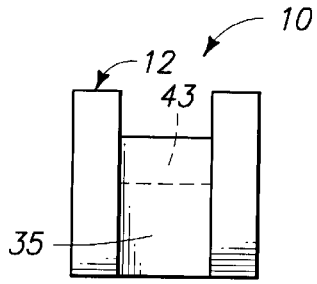

Further, as shown in FIG. 35, the first block 12 is illustrated including a first height dimension D between top and bottom surfaces. The head 52 of the key block 50 is shown to include a head height dimension H (FIG. 35) that is approximately equal to the height dimension D of the first block 12. The head height dimension may be altered as exemplified in other figures (see examples illustrated in FIGS. 36–39) where the head height dimension here is approximately half the first block height dimension D. The head 52 may be used in the FIG. 35 configuration to interlock within the head receiving recess 35 of the first blocks 12 (FIG. 28 and others), and may overlap adjacent first or second blocks to more completely anchor tiers of blocks together as may be understood from viewing FIGS. 75 and 78.

FIGS. 48–73 demonstrate that the first block 12 may be formed in different configurations and that one or more of the key sockets 40 may be provided. In fact, the block configuration shown in FIGS. 48–52 include two opposed key sockets 40 opposite ends of the block configuration with the adjoining head receiving recesses formed in the block ends. This configuration is useful to produce wall and other structural arrangements, examples of which are illustrated in FIGS. 77 and 78.

Figure 53:
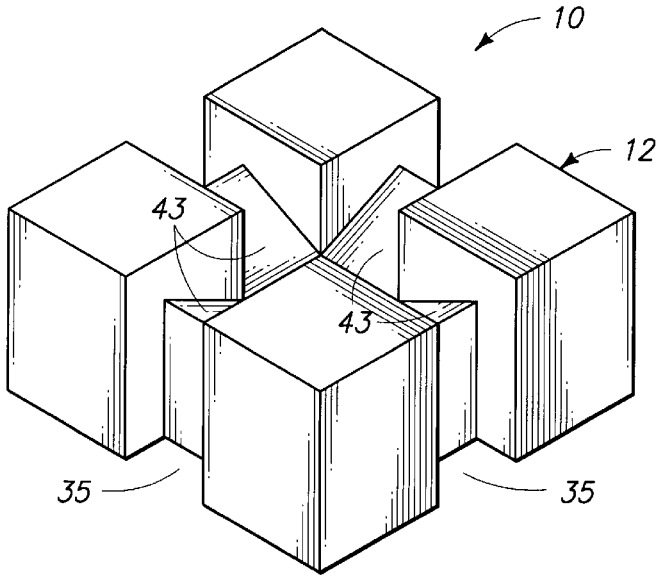
FIG. 53 is a perspective view of exemplary first block in a substantially rectangular configuration.
Figure 54:
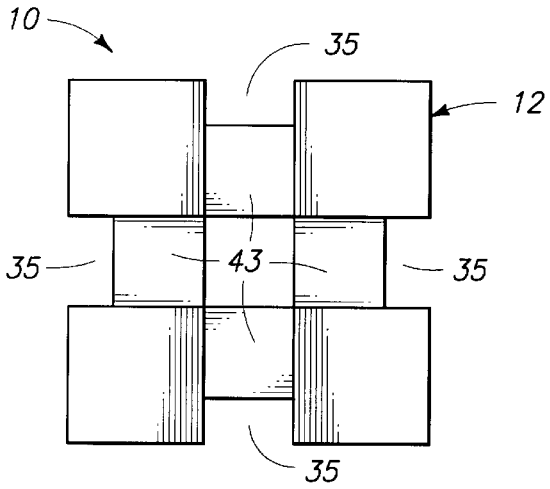
FIGS. 54 and 55 are orthographic views of the block example of FIG. 53.
Figure 55:
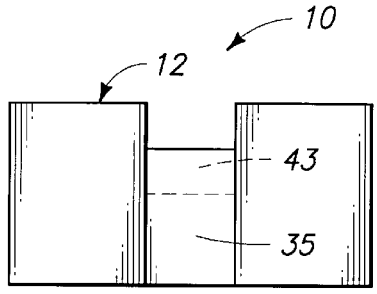
Figure 56:
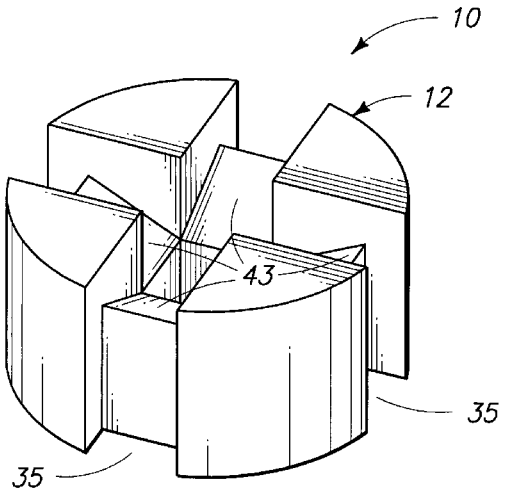
FIG. 56 is a perspective view of a first block in a round configuration.
Figure 57:
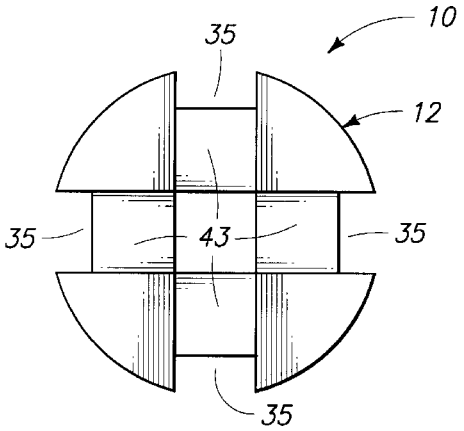
FIGS. 57 and 58 are orthographic views of the block shown in FIG. 56.
Figure 58:
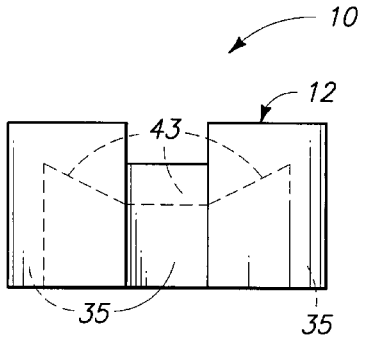
Figure 59:
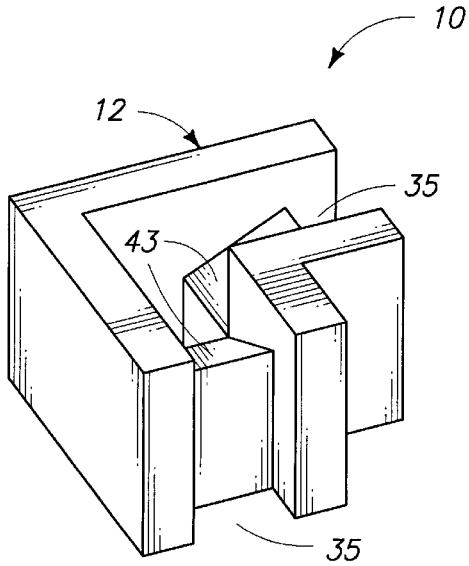
FIG. 59 is a perspective view of an exemplary first block in an "L" configuration.
Figure 61:
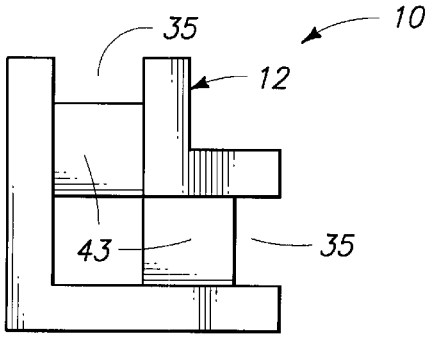
FIGS. 60 and 61 are orthographic views of the block shown in FIG. 59.
Figure 60:
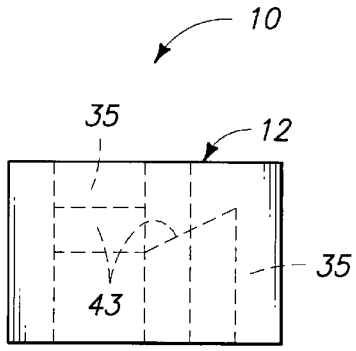
Figure 62:
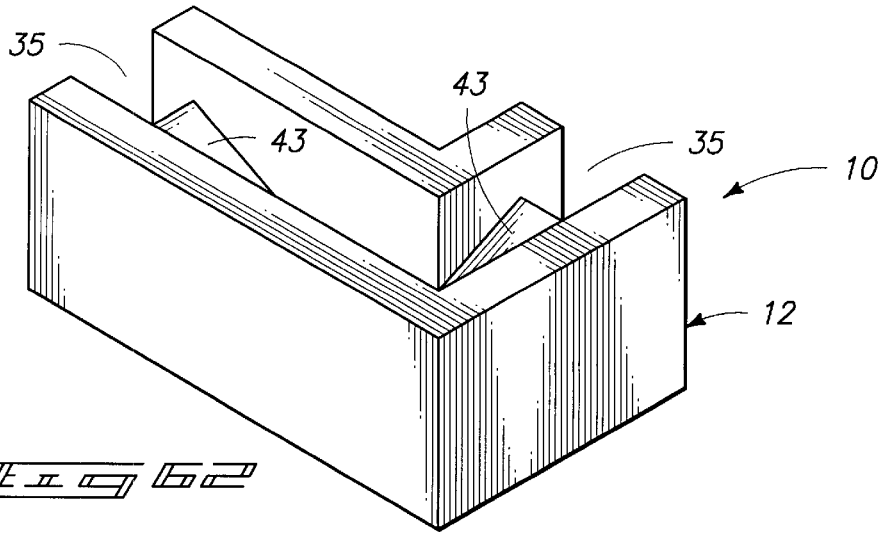
FIG. 62 is a perspective view of an exemplary first block in an "L" configuration of different dimensions than that shown in FIGS. 59–61.
Figure 63:
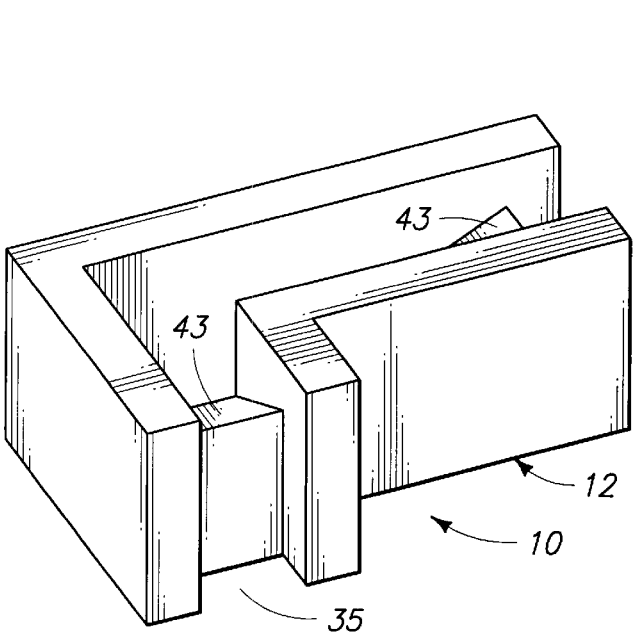
FIG. 63 is a perspective view of the exemplary block configuration of FIG. 62 from a different angle.
Figure 64:
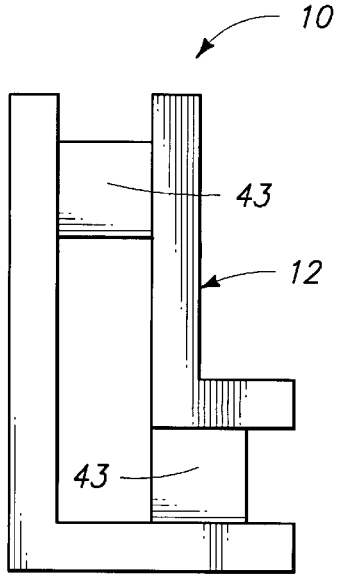
FIGS. 64 and 65 are perspective views of the block shown in FIGS. 62 and 63.
Figure 65:
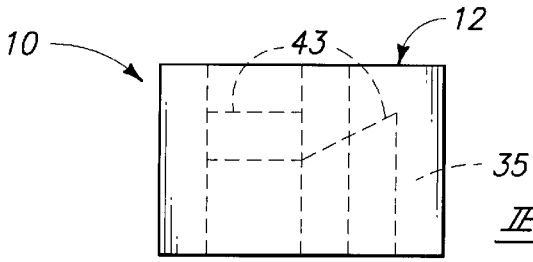
Figure 71:
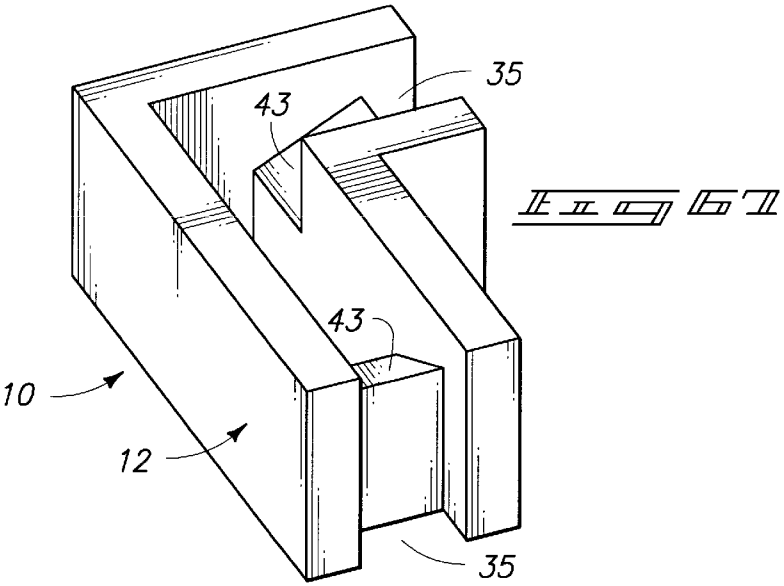
Figure 69:
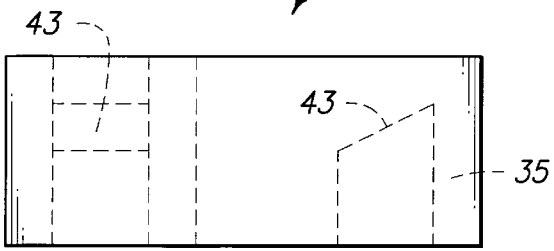
FIGS. 68 and 69 are orthographic views of the block shown in FIGS. 66 and 67.
Figure 66:
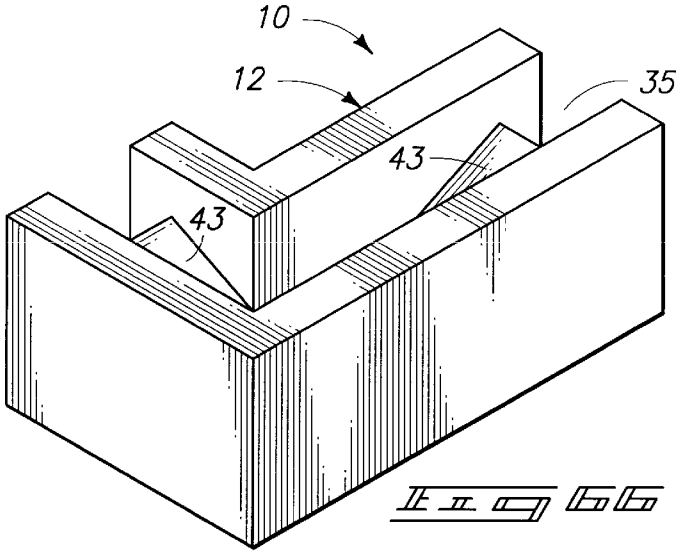
Figure 68:
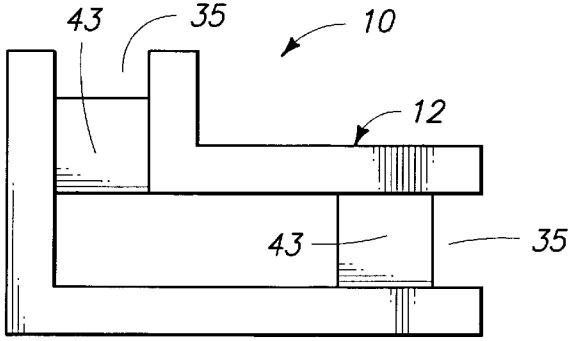
Figures 11, 12, 13, 14:
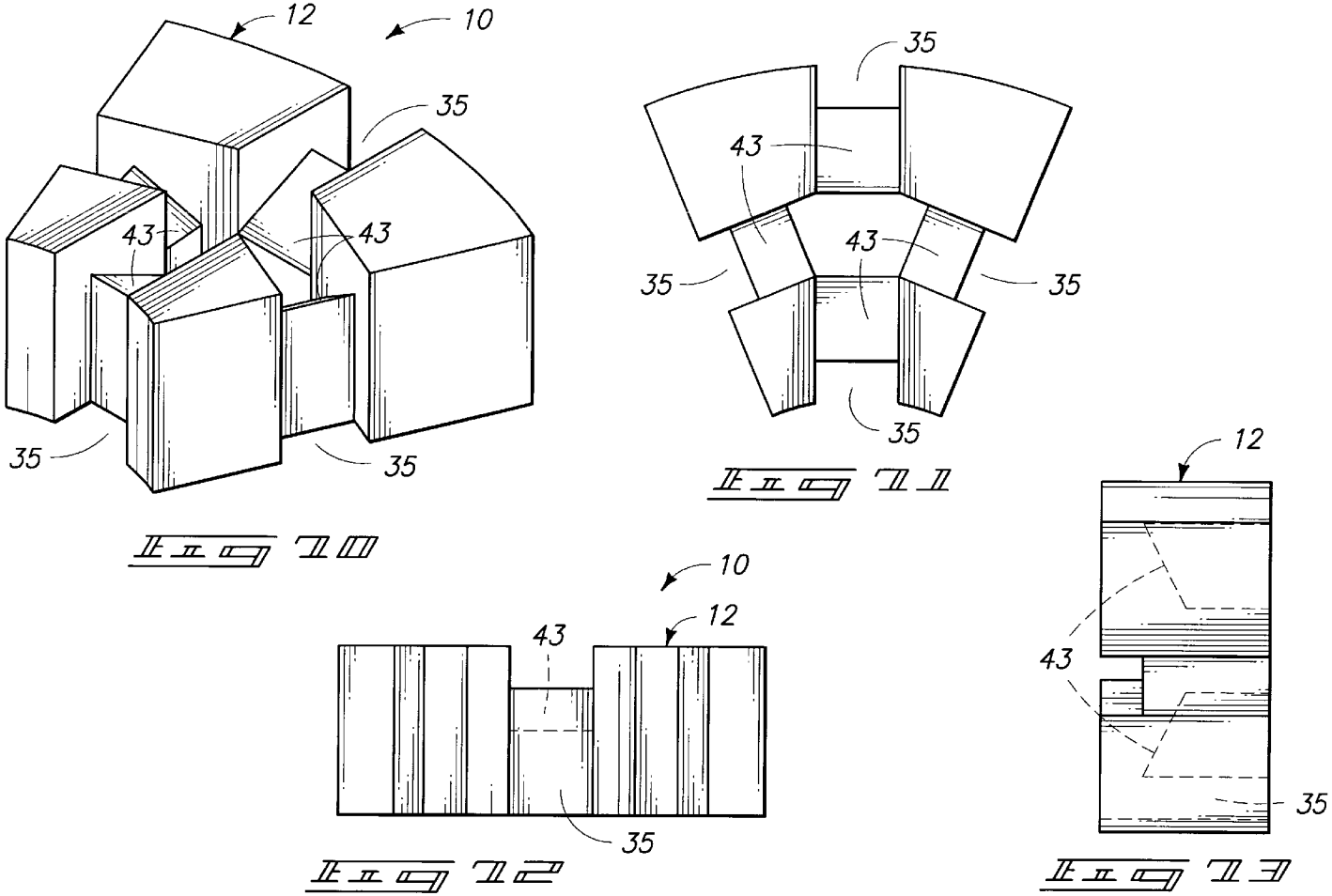
Figure 59H:
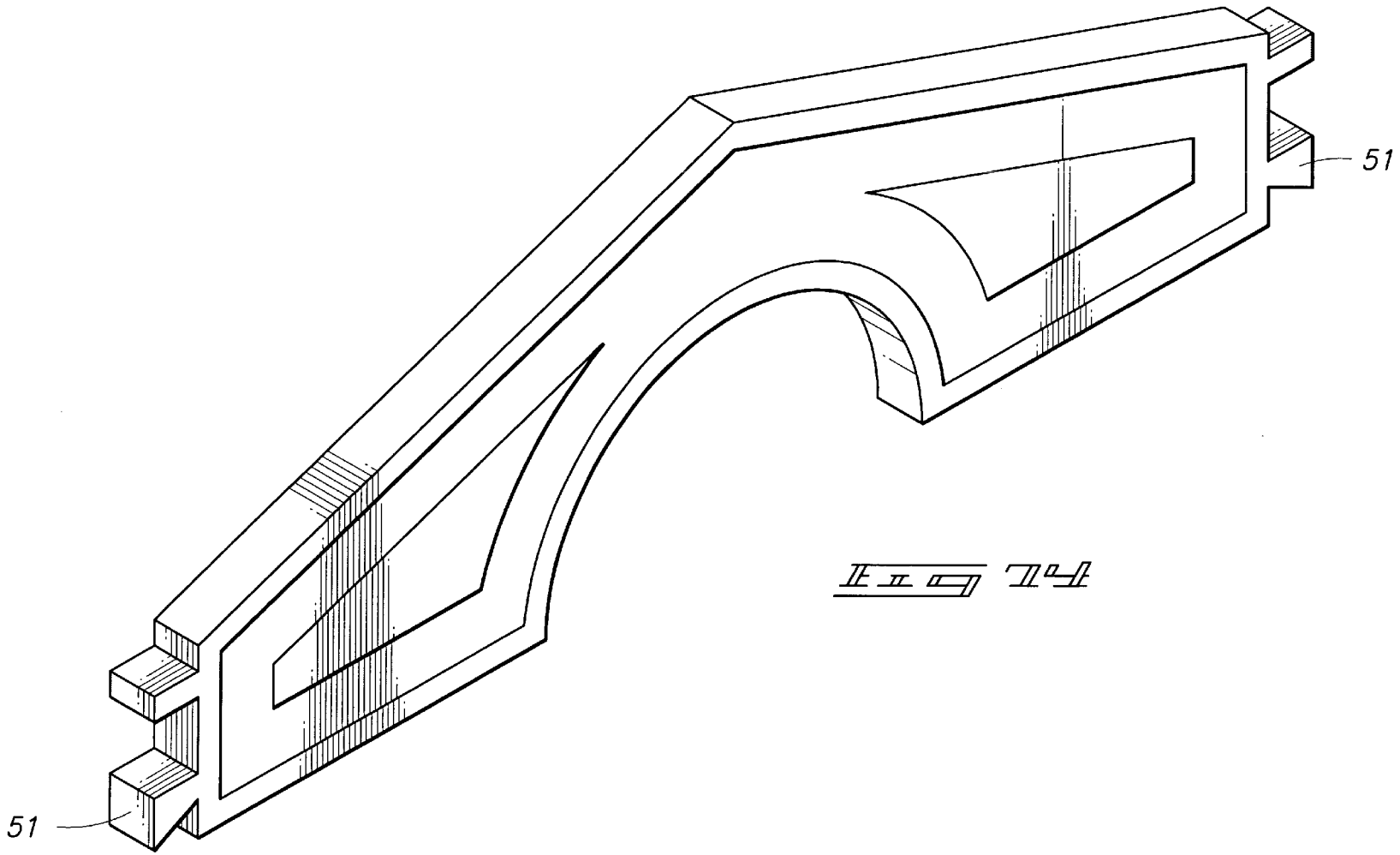

The first block configuration shown in FIGS. 53–55 includes a substantially square configuration in which four of the key sockets 40 are provided with an equal number of adjacent head receiving recesses 35. Similarly, a circular shape is exemplified in FIGS. 56–58, indicating a variation of the block construction that will allow for a substantially cylindrical structural configuration to be formed. Partially circular or triangular "pie" shaped blocks as shown in FIGS. 70–73 allow for still further construction variations.

Corner configurations are illustrated in FIGS. 59–69. These configurations are "L" shaped but otherwise are similar in construction to the block configuration shown in FIGS. 48–52. The sides of the "L" shaped configuration may be varied to facilitate staggered wall construction as shown in FIG. 76, or to permit construction of an aligned matrix configuration substantially as shown in the back wall configuration in FIG. 75 and the partial wall shown in FIG. 78.

Variations may also be provided in the key block 50, several of which are illustrated in FIGS. 32–47. The block configuration of FIG. 32 may be used to substantially interlock successive layers of first block configurations together. The head in this version will overlap one block and partially overlap within the head receiving recess of the next block above. The head 52, being received within the head receiving recess 35, snugly fits and effectively prevents movement of the blocks relative to one another.

The configuration shown in FIGS. 36–39 may be used in a manner similar in that described above with the exception that the top portion of the head 52 is removed to facilitate a flush fit along top surfaces of structures where it is not desired that the upward head portion be exposed.

FIGS. 40–43 show a key block 50 in which opposed tails 51 are used with a substantially centrally located head portion 52. This form of the key block 50 may be used for interconnecting horizontally adjacent first block configurations. An example of this relationship is illustrated in FIG. 77 where adjacent first blocks are interconnected by the "bowtie" key block 50 configuration shown in FIGS. 40–43. The key block 50 configuration shown in FIGS. 44–47 may be used to avoid the situation shown in FIG. 77 in which upward portions of the heads are exposed above the top surface of the wall. With the head portions removed, the top surface of the wall may be substantially flat.

The "pie" shaped block configuration shown by way of example in FIGS. 70–73 also include a number of key sockets 40 and adjacent or adjoining head receiving recesses 35. These block configurations may be used as partial sections to form, ultimately, a cylindrical configuration, where they may be used to simply form curves or corners along a wall or other structure.

Figure 21:
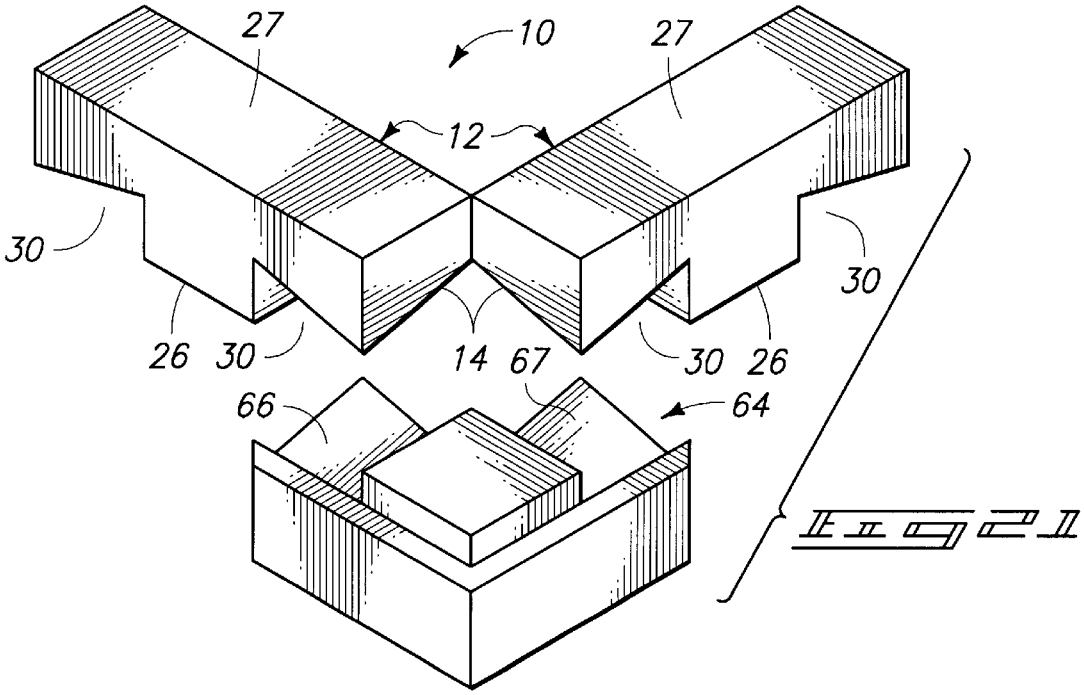
FIG. 21 is a partially exploded perspective view showing a corner constructed with an "L" shaped block and two straight block components.

In use, many different structures may be built with the variety offered by the present interlocking block components. In a basic construction, a simple single tier plinth or foundation may be set simply by leveling a support surface and placing a number of the blocks in end-to-end locking engagement along the plinth or foundation perimeter. At corners, either the "L" shaped members 64 (FIGS. 21, 27), the junction blocks 20 (FIG. 24), or right angle interlock between blocks (FIG. 25) may be used.

Figure 3:
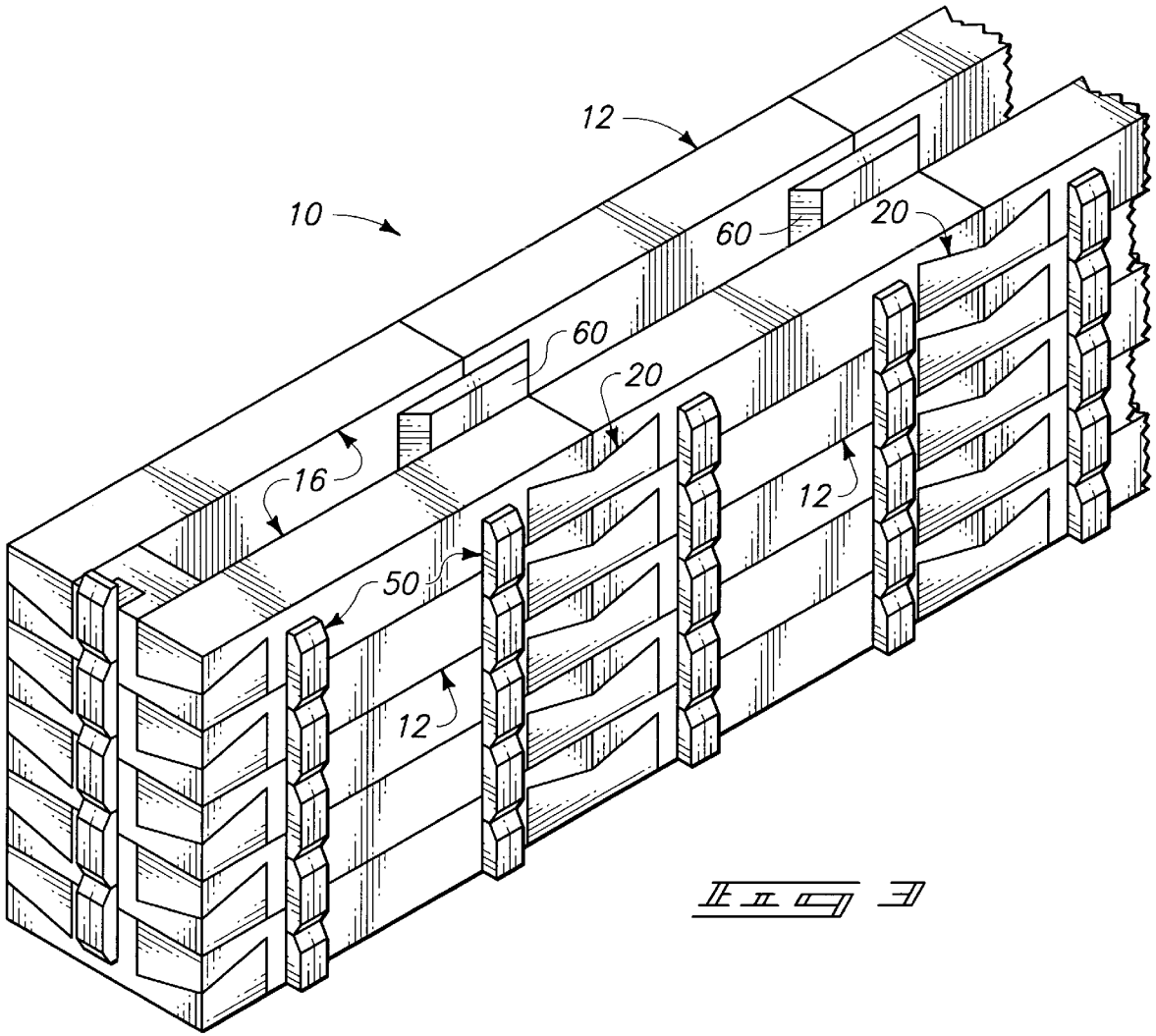
FIG. 3 is a fragmented perspective view of a wall construction assembled using presently preferred components.

If a structure such as a retaining wall is to be constructed with more than one tier of blocks, as demonstrated by FIG. 3, the same procedure may be used, with successive tiers laid one on another until the desired height is achieved. However, it is advisable that key members 50 be used between successive layers to assure lateral stability. The bearing weight of blocks resting one on another will assure positive mechanical interlocking of the blocks, while the key members 50 and buttress surfaces 60, 65 function to resist lateral block movement.

If a structure such as a retaining wall is to be constructed with more than one tier of blocks, as demonstrated by FIG. 3, the same procedure may be used, with successive tiers laid one on another until the desired height is achieved. However, it is advisable that key members 50 be used between successive layers to assure lateral stability. The bearing weight of blocks resting one on another will assure positive mechanical interlocking of the blocks, while the key members 50 and buttress surfaces 60, 65 function to resist lateral block movement.

FIG. 23 shows the start of a retaining wall which may be constructed with one or more elongated rails 55 extending to one side. The rail ends may be connected to the wall by way of appropriately facing key sockets, and extend to a side of the wall to be connected in a similar manner to a block 12 or 16 that is used as a "deadman" or anchor. The rail and deadman arrangement may be used in loose earth or areas where ground movement is possible, to increase structural stability of the wall.

The double wall structure shown in FIGS. 3 can be used as a retaining wall, a partition wall, fence, or a structural load bearing wall. Many other formations may be elected and different combinations of the described elements may be placed to arrive at numerous visually appealing patterns without sacrificing structural integrity.

The double wall structure may also be made with other combinations of blocks. For example, see FIG. 27 where "L" shaped corner blocks 64 and junction blocks 20 are used at the wall ends. This relationship allows for the key sockets 40 on the blocks making up the long parts of the walls to face one another. Pairs of transversely aligned sockets 40 may receive a short version of the rail 55, shown as an internal tie bar 56 extending between the two partially formed walls. A desired number of the tie bars 56 may be used, according to the number of facing key socket pairs, to structurally tie the double walls together in a strong, secure manner. The tie bars 56 (like the rails 55) will include shaped ends (see FIG. 4) that are similar if not identical to the key member tails 51, with wall engaging surfaces adjacent to the tails that overlap and abut the inwardly facing surfaces of the associated blocks much in the same manner as the abutment walls 53 of the key members 50.

Figure 2:
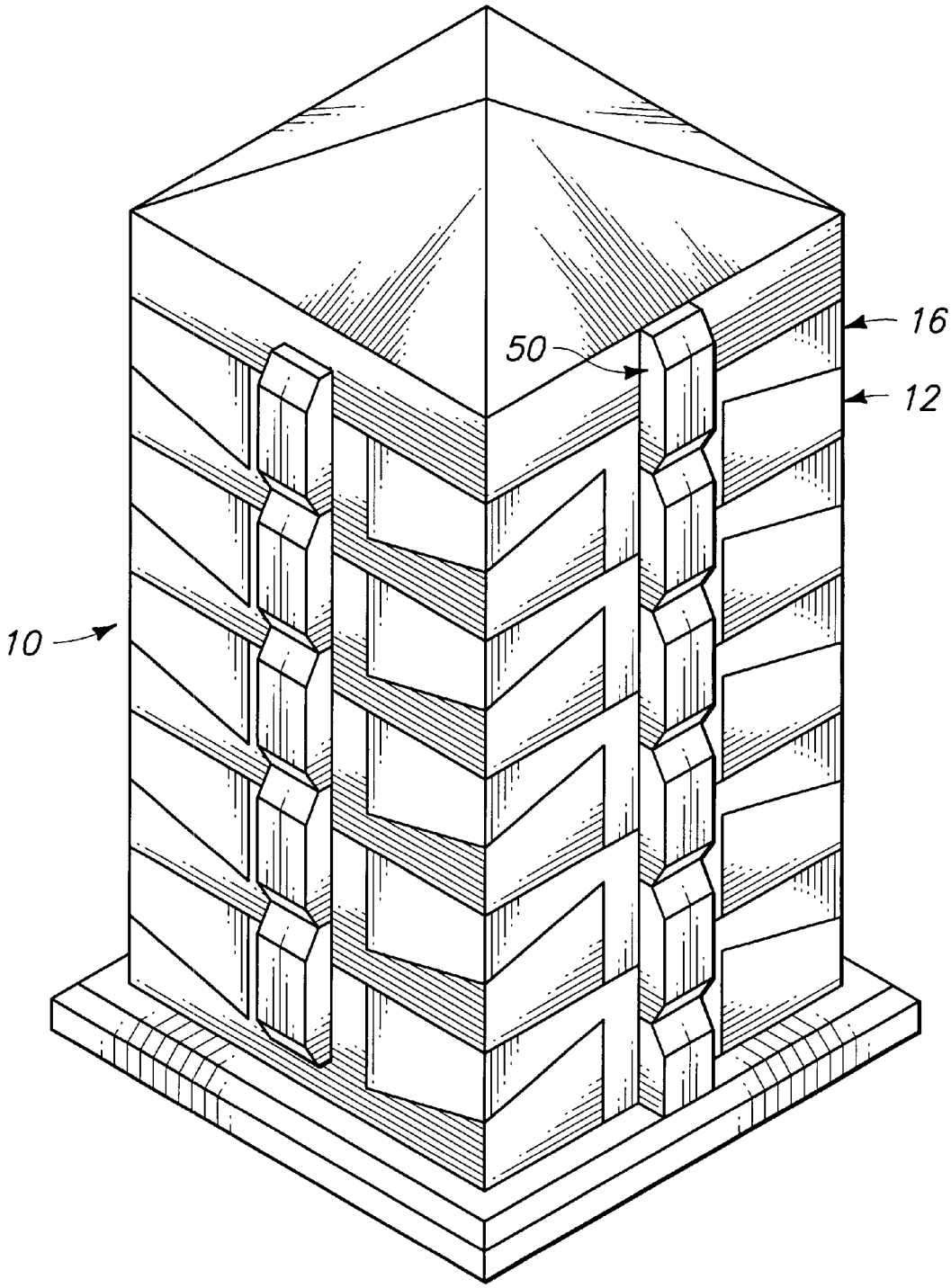
FIG. 2 is a perspective view of a pillar or post formed using exemplary block components.
Figure 5:
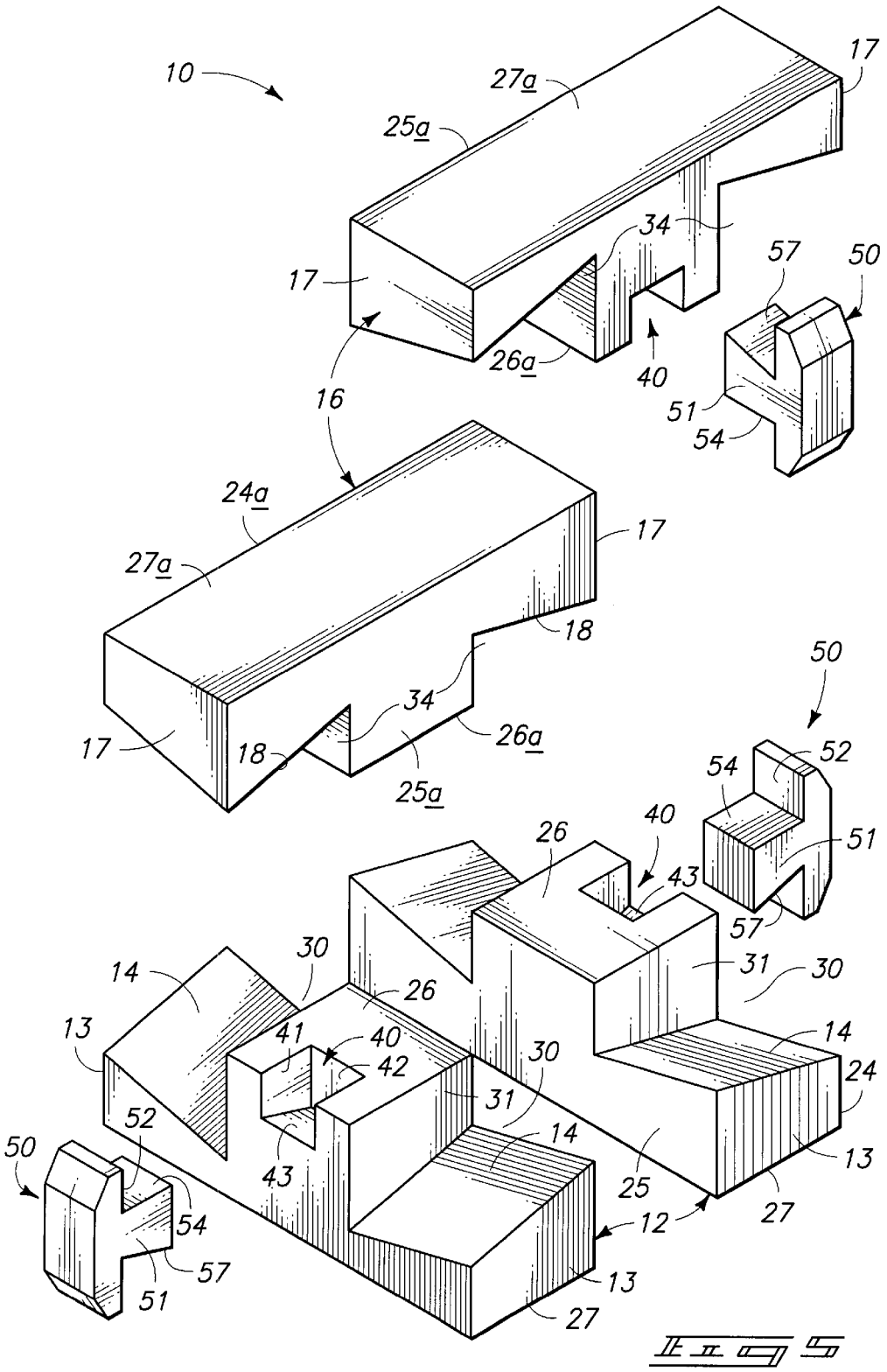
FIG. 5 is an exploded view showing alignment of components for interconnection.

FIG. 1 shows a fence built with short blocks making up pillars and rails 55 spanning the distance between pillars. The rail ends fit within key sockets 40 that would otherwise accept key members 50. Construction of an individual pillar is graphically shown in FIGS. 2, 4 and 5.

Figure 75:
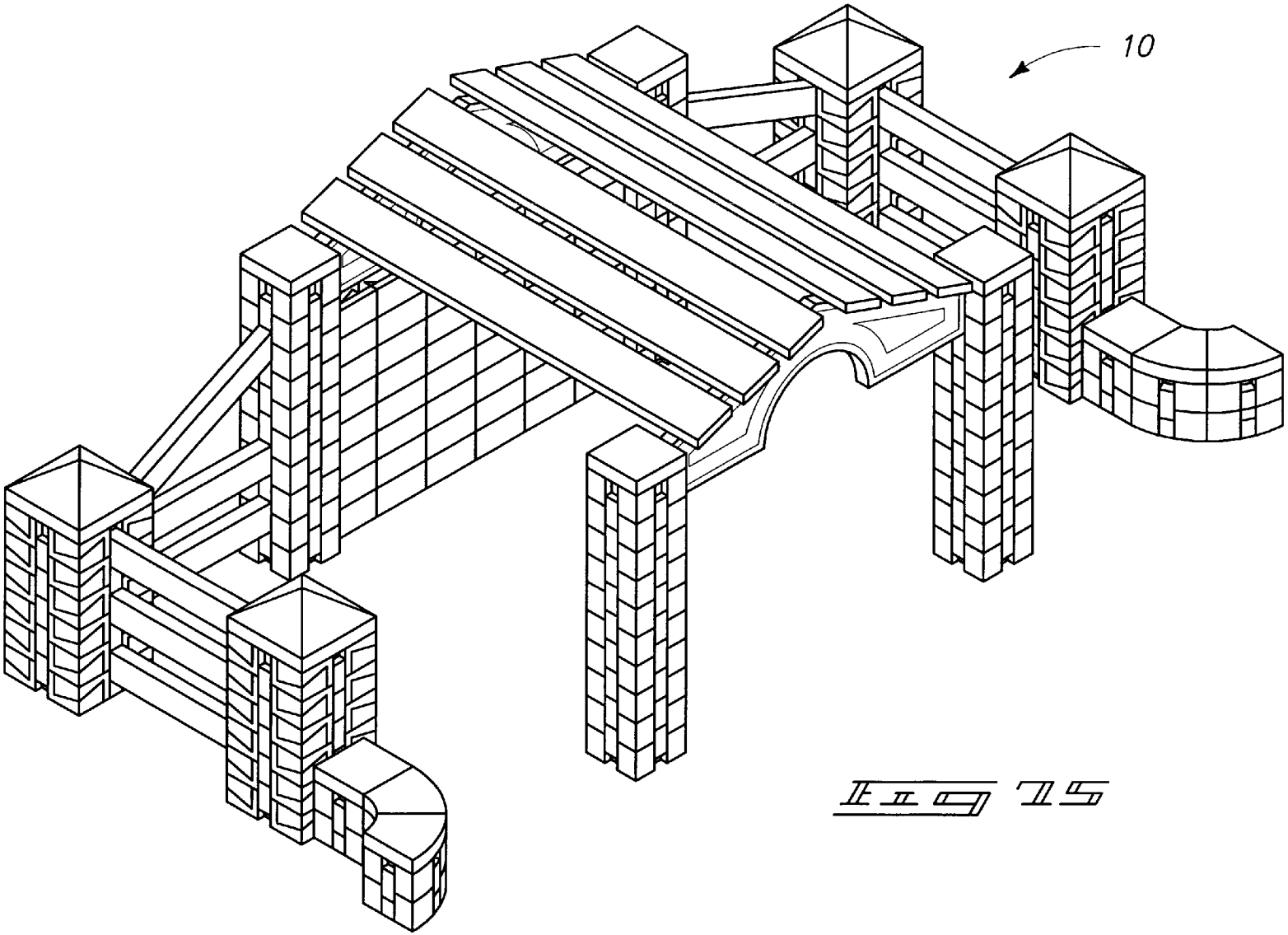
FIG. 75 is a perspective view of a structure formed from blocks shown in FIGS. 28–74.
Figure 26:
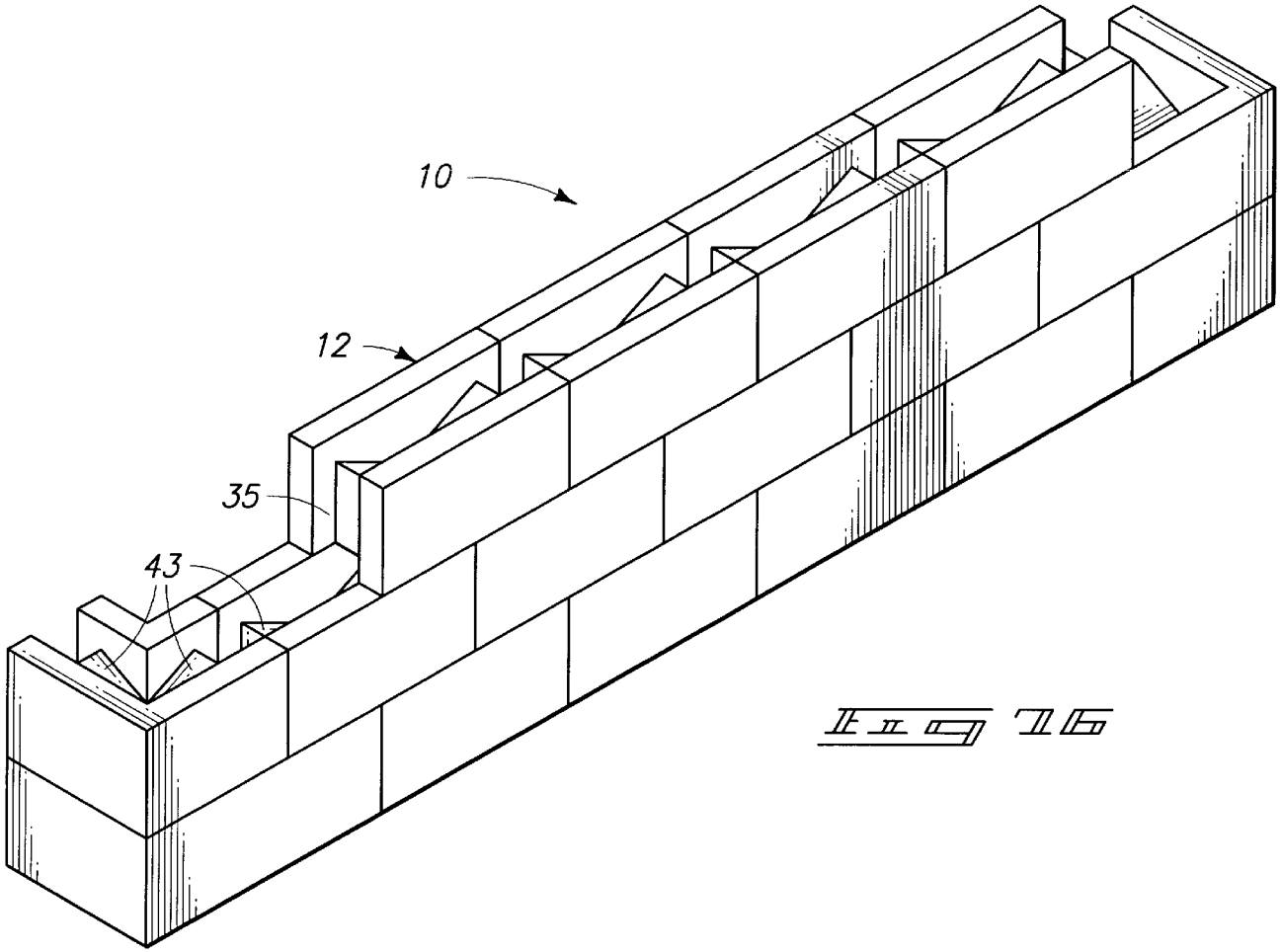
Figure 11:
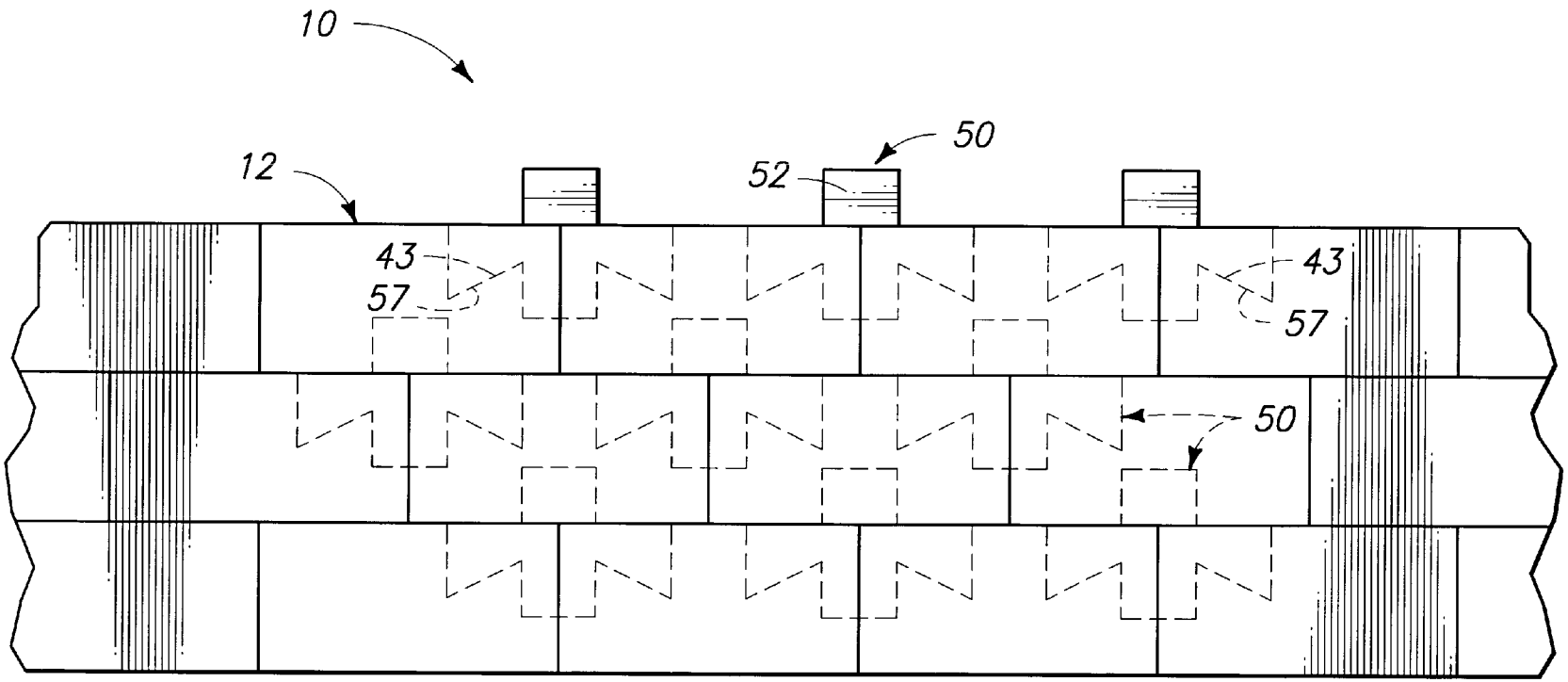
Figure 11:
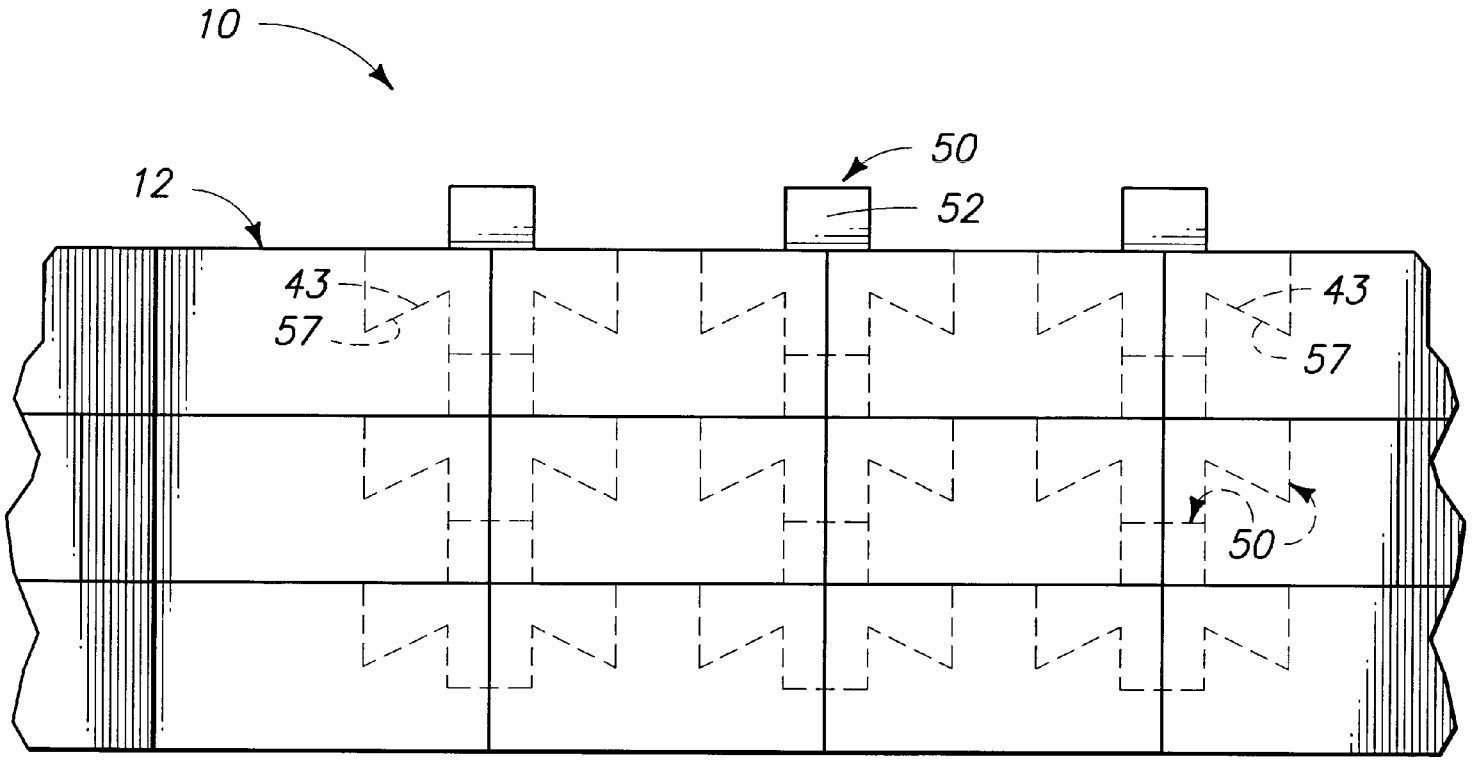

FIG. 75 shows a structure built with a number of block configurations, especially those exemplified in FIGS. 28–74. Attention is drawn to the elongated key members with key tails such as the gable structure shown in FIG. 74. Note is also made with respect to the rearward wall configuration and that the blocks therein are aligned with joints in horizontal and vertical alignment. This formation is possible by use of equal length blocks joined by key blocks, though alternate block spacing may be achieved by using unequal block lengths as shown by FIGS. 76 and 77.

In any of above or other conceivable arrangements of the present components, the individual blocks interlock in a positive manner without the need for additional fasteners or mortar joints, though such materials may be used if desired. The blocks may be fitted together quickly and accurately, thereby simplifying and lowering the labor costs for what could otherwise be expensive and time-consuming masonry construction.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. Interlocking construction components, comprising:

a elongated first block formed along a longitudinal first axis;

a first interlock surface on the first block, formed at an oblique angle to the first axis;

a second elongated block formed along a longitudinal second axis;

a second interlock surface on the second block formed at an oblique angle to the second axis; and wherein the first and second interlock surfaces interfit and longitudinally interlock with the first and second axes in substantial alignment;

wherein the first and second blocks include top and bottom surfaces defining a thickness dimension and wherein each of the interlock surfaces is bounded by edges forming a four sided polygonal configuration, with corners of the polygonal configuration spaced toward the top surface from the bottom surface by distances of approximately ¾, ½, ½ and ¼ of the thickness dimension.

2. Interlocking construction components as defined by claim 1 wherein the first and second blocks include end surfaces and bottom surfaces and wherein the interlock surfaces lead angularly from the end surfaces toward the bottom surfaces.

3. Interlocking construction components as defined by claim 1 wherein at least one of the first and second blocks includes a key socket formed therein and defined by side socket walls leading to an end socket wall and a bottom socket wall;

wherein at least one of the side and bottom socket walls forms an acute angle with the end socket wall; and a key member having a key tail shaped complementary to and slidably received within the key socket, and a buttress head with at least one side surface abutment wall projecting from the key tail.

4. Interlocking construction components as defined by claim 1 further comprising a junction block including symmetrical, mirror image mating surfaces that are complementary to the first and second interlock surfaces.

5. Interlocking construction components as defined by claim 1 further comprising a junction block including symmetrical, mirror image mating surfaces that are complementary to the first and second interlock surfaces, and a buttress surface adjacent the mirror image mating surfaces.

6. Interlocking construction components, comprising:

a first block including a first end:

a first interlock surface formed across the first end;

a second block including a second end;

a second interlock surface formed across the second end; and a junction block including symmetrical, mirror image mating surfaces that are complementary to the first and second interlock surfaces for joining the first and second blocks together in end-to-end engagement; and wherein the mirror image mating surfaces, the first interlock surface, and the second interlock surface interchangeably interfit in any of several angular relationships;

wherein at least one of the blocks is elongated between opposed ends and wherein the interlock surface is provided on at least one of the opposed ends.

7. Interlocking construction components as defined by claim 6 wherein the first and second masonry blocks include side surfaces and wherein the interlock surfaces are angularly oblique relative to the side surfaces.

8. Interlocking construction components as defined by claim 6 wherein the first and second masonry blocks include side surfaces and wherein the junction block includes a buttress surface adjacent the mirror image mating surfaces for abutment with the block side surfaces.

9. Interlocking construction components as defined by claim 6 wherein the second masonry block is "L" shaped and the second end is on at least one leg of the "L" shape.

10. Interlocking construction components as defined by claim 6 wherein one of the blocks is "L" shaped and one of the interlock surfaces is provided thereon along at least one end of the "L" shape, and further comprising a buttress surface adjacent the one interlock surface.

11. Interlocking construction components as defined by claim 6, further comprising:

a key socket formed in one of the blocks and defined by side socket walls leading to an end socket wall and a bottom socket wall;

wherein at least one of the side and bottom socket walls forms an acute angle with the end socket wall;

a key member having a key tail shaped complementary to and slidably received within the key socket, and a buttress head with at least one side surface abutment wall projecting from the key tail.

12. Interlocking construction components, comprising:

a first elongated block with side surfaces joined by top and bottom surfaces defining a cross sectional shape at a block end;

a first notch formed in the first block and defined by:

(a) the block end, (b) a notch end surface spaced along the first block from the block end, and (c) an interlock surface oriented at an oblique angle to and joining the block end and the notch end surface and bounded by edges that form a polygon with two diagonally opposed corners of the polygon being spaced equal distances from the bottom surface and a remaining two diagonally opposed corners of the polygon being spaced unequally from the bottom surface; and a second block with a second notch formed therein of complementary configuration to the first notch for a reception by the first notch.

13. Interlocking construction components as defined by claim 12 wherein the notch end surface is substantially perpendicular to the side surfaces.

14. Interlocking construction components as defined by claim 12 wherein the interlock surface forms an acute angle with the notch end surface.

15. Interlocking construction components, comprising:

a first block;

side surfaces on the first block;

top and bottom surfaces joining the side surface and defining a cross sectional shape;

a key socket formed in the first block;

wherein the key socket opens on two adjacent ones of said side, top and bottom surfaces;

wherein the key socket is defined by side socket walls leading to an end socket wall and a bottom socket wall;

wherein at least one of the side and bottom socket walls forms an acute angle with the end socket wall;

a second block;

second side surfaces on the second block;

second top and bottom surfaces on the second block, shaped to be received in stacked relation on the first block with at least two side surfaces positioned adjacent the key socket and with said at least two side surfaces being substantially coplanar; and a key member having a tail shaped complementary to and slidably received within the key socket, and a buttress head with at least one side surface abutment wall projecting from the key tail and in flush engagement with the second block.

16. Interlocking construction components, as defined by claim 15 further comprising:

a first notch formed in the first block and defined by:

(a) the block end, (b) a notch end surface spaced along the block from the block end, and (c) an interlock surface oriented at an oblique angle to the side surfaces; and wherein the second block includes a second notch formed therein of complementary configuration to the first notch.

17. Interlocking construction components, comprising:

a first block;

a key socket on the first block;

an inclined socket wall within the key socket;

a head receiving recess formed in the first block and adjoining the key socket;

a key block;

an inclined surface on the key block formed in complementary shape to the inclined socket wall to interlock with the inclined socket wall;

a head on the key block shaped to be received within the head receiving recess and with the inclined socket wall engaging the inclined surface of the key block; and wherein the first block includes multiple inclined socket walls and a head receiving recess for each inclined socket wall, and wherein the key block includes a number of inclined surfaces that are equal to the number of inclined socket walls.

18. Interlocking construction components as defined by claim 17 wherein the key block includes a tail that defines the inclined surface and wherein the head is substantially normal to the tail.

19. Interlocking construction components as defined by claim 17 wherein the first block includes a top and a bottom surface defining a thickness dimension and wherein the inclined socket wall is disposed between the top and bottom surfaces.

20. Interlocking construction components as defined by claim 17 wherein the key block includes two tails projecting in opposed directions from the head.

21. Interlocking construction components as defined by claim 17 wherein the first block is substantially rectangular with the key socket and head receiving recess substantially centered between ends thereof.

22. Interlocking construction components as defined in claim 17 wherein the first block is at least semi-circular.

23. Interlocking construction components as defined in claim 17 wherein the first block is substantially "L" shaped, with key sockets and head receiving recesses at opposed ends thereof.

24. Interlocking construction components as defined in claim 17 wherein the first block is rectangular with key sockets and head receiving recesses at opposed ends thereof.

25. Interlocking construction components as defined by claim 17 wherein the first block includes side surfaces and interlock surfaces that are situated to opposed sides of the inclined socket wall and wherein the interlock surfaces that are angularly oblique relative to the side surfaces.

26. Interlocking construction components as defined by claim 17 wherein the first block includes a first height dimension between top and bottom surfaces and wherein the head includes a head height dimension approximately equal to the first height dimension.

27. Interlocking construction components, comprising:

a first block;

a key socket on the first block;

an inclined socket wall within the key socket;

a head receiving recess formed in the first block and adjoining the key socket;

a key block;

an inclined surface on the key block formed in complementary shape to the inclined socket wall to interlock with the inclined socket wall;

a head on the key block shaped to be received within the head receiving recess and with the inclined socket wall engaging the inclined surface of the key block;

wherein the head receiving recess includes a recess width dimension and the key block includes a head width dimension less than the recess width dimension.

28. Interlocking construction components as defined by claim 27 wherein the first block includes a top surface and a bottom surface and wherein the head receiving recess extends across the at least one of the top and bottom surfaces.

29. Interlocking construction components, comprising:

a first block;

a key socket on the first block;

an inclined socket wall within the key socket;

a head receiving recess formed in the first block and adjoining the key socket;

a key block;

an inclined surface on the key block formed in complementary shape to the inclined socket wall to interlock with the inclined socket wall;

a head on the key block shaped to be received within the head receiving recess and with the inclined socket wall engaging the inclined surface of the key block;

wherein the first block is elongated between opposed ends and wherein the head receiving recess is formed in at least one of the opposed ends.

30. Interlocking construction components, comprising:

a first block;

a key socket on the first block;

an inclined socket wall within the key socket;

a head receiving recess formed in the first block and adjoining the key socket;

a key block;

an inclined surface on the key block formed in complementary shape to the inclined socket wall to interlock with the inclined socket wall;

a head on the key block shaped to be received within the head receiving recess and with the inclined socket wall engaging the inclined surface of the key block;

wherein the first block includes opposed side surfaces and wherein the head receiving recess is formed in at least one of the opposed side surfaces.

31. Interlocking construction components as defined by claim 30 wherein the key block is elongated with inclined surfaces at opposed ends thereof.

32. Interlocking construction components, comprising:

a first block;

a key socket on the first block;

an inclined socket wall within the key socket;

a head receiving recess formed in the first block and adjoining the key socket;

a key block;

an inclined surface on the key block formed in complementary shape to the inclined socket wall to interlock with the inclined socket wall; and a head on the key block shaped to be received within the head receiving recess and with the inclined socket wall engaging the inclined surface of the key block;

a first interlock surface on the first block, formed at an oblique angle;

a second block;

a second interlock surface on the second block formed at an oblique angle; and wherein the first and second interlock surfaces interfit and secure the first and second blocks together.

* * * * *